US008125307B2

(12) United States Patent
Sato et al.

(10) Patent No.: US 8,125,307 B2
(45) Date of Patent: Feb. 28, 2012

(54) AGGREGATE SUBSTRATE, PRODUCTION METHOD OF AGGREGATE SUBSTRATE, AND VARISTOR

(75) Inventors: Hiroyuki Sato, Tokyo (JP); Yo Saito, Tokyo (JP); Ryuichi Tanaka, Tokyo (JP); Makoto Numata, Tokyo (JP); Goro Takeuchi, Tokyo (JP)

(73) Assignee: TDK Corporation, Tokyo (JP)

( * ) Notice: Subject to any disclaimer, the term of this patent is extended or adjusted under 35 U.S.C. 154(b) by 539 days.

(21) Appl. No.: 12/275,852

(22) Filed: Nov. 21, 2008

(65) Prior Publication Data

US 2009/0189732 A1 Jul. 30, 2009

(30) Foreign Application Priority Data

Jan. 25, 2008 (JP) ..... 2008-015243

(51) Int. Cl.
*H01C 7/10* (2006.01)

(52) U.S. Cl. ..... 338/20; 338/21; 338/22 R

(58) Field of Classification Search ..... 338/20–21, 338/22 R, 25

See application file for complete search history.

(56) References Cited

U.S. PATENT DOCUMENTS 5,119,062 A * 6/1992 Nakamura et al. ..... 338/20

(Continued)

FOREIGN PATENT DOCUMENTS

CN 1680749 A 10/2005

(Continued)

OTHER PUBLICATIONS

Decision of Patent Grant for corresponding Korean Patent Application No. 2008-0117887, dated Dec. 17, 2010 (w/ English translation).

(Continued)

*Primary Examiner* — Kyung Lee
(74) *Attorney, Agent, or Firm* — Oliff & Berridge

(57) ABSTRACT

An aggregate substrate has a first varistor part, a second varistor part, and a heat dissipation layer. The first varistor part includes a first varistor element layer to exhibit nonlinear voltage-current characteristics, and a plurality of first internal electrodes juxtaposed in the first varistor element layer. The second varistor part includes a second varistor element layer to exhibit nonlinear voltage-current characteristics, and a plurality of second internal electrodes juxtaposed in the second varistor element layer. The heat dissipation layer is located between the first and second varistor parts and is in contact with the first and second varistor parts.

10 Claims, 20 Drawing Sheets

U.S. PATENT DOCUMENTS

| | | | | |
|---|---|---|---|---|
| 5,739,742 | A * | 4/1998 | Iga et al. | 338/21 |
| 5,870,273 | A * | 2/1999 | Sogabe et al. | 361/306.3 |
| 7,705,709 | B2 | 4/2010 | Saito et al. | |

FOREIGN PATENT DOCUMENTS

| | | |
|---|---|---|
| JP | A-61-202495 | 9/1986 |
| JP | A-64-33990 | 2/1989 |
| JP | A-2-135702 | 5/1990 |
| JP | A-8-153606 | 6/1996 |
| JP | A-09-283339 | 10/1997 |
| JP | A-2000-331881 | 11/2000 |
| JP | A-2002-246207 | 8/2002 |
| JP | A-2002-270453 | 9/2002 |
| JP | A-2005-27402 | 1/2005 |
| JP | A-2007-266092 | 10/2007 |
| KR | B1-10-0732785 | 6/2007 |

OTHER PUBLICATIONS

Notice of Reasons for Rejection for Japanese Application No. 2008-015243, mailed on Feb. 16, 2010.

* cited by examiner

AGGREGATE SUBSTRATE, PRODUCTION METHOD OF AGGREGATE SUBSTRATE, AND VARISTOR

BACKGROUND OF THE INVENTION

1. Field of the Invention

The present invention relates to an aggregate substrate, a production method of an aggregate substrate, and a varistor.

2. Related Background Art

There is a known varistor having a varistor part of a nearly rectangular parallelepiped shape to exhibit nonlinear voltage-current characteristics, a pair of internal electrodes located in this varistor part and opposed to each other with a portion of the varistor part in between, and a pair of terminal electrodes formed on an exterior surface of the varistor part and connected to the respective corresponding internal electrodes (e.g., cf. Japanese Patent Application Laid-open No. 2002-246207).

SUMMARY OF THE INVENTION

Incidentally, the varistor is connected in parallel to an electronic device such as a semiconductor light emitting device or FET (Field Effect Transistor) to protect the electronic device from an ESD (Electrostatic Discharge) surge. Some of such electronic devices generate heat during operation. When the electronic device becomes hot, the properties of the device itself become deteriorated to affect the operation thereof. For this reason, it is necessary to efficiently dissipate the heat generated.

Then the inventors considered that the heat could be dissipated from the varistor in such a manner that a heat dissipation part with a heat dissipation function was provided in contact with the varistor part and that the heat transferred to the varistor was dissipated form the heat dissipation part. However, this method has the following problem.

A conventional varistor production process involves making an aggregate substrate including a plurality of varistor parts. The aggregate substrate is obtained by laminating green sheets to become the varistor parts, electrode patterns to become the internal electrodes, etc. to form a multilayer green body, and firing this multilayer green body.

For producing the varistors with the heat dissipation part, the aggregate substrate is made by laminating green sheets to become the varistor parts, electrode patterns to become the internal electrodes, green sheets to become the heat dissipation part, etc. to form a multilayer green body, and firing it. When this multilayer green body is fired, there is difference between contraction caused by firing of the varistor parts and contraction caused by sintering of the heat dissipation part, which can cause warpage of the aggregate substrate.

An object of the present invention is therefore to provide a varistor capable of efficiently dissipating heat, and an aggregate substrate for production of this varistor Another object of the present invention is to provide a production method of an aggregate substrate capable of suppressing occurrence of warpage.

An aggregate substrate according to the present invention is an aggregate substrate comprising: a first varistor part comprising a first varistor element layer to exhibit nonlinear voltage-current characteristics, and a plurality of first internal electrodes juxtaposed in an extending direction of the first varistor element layer in the first varistor element layer, the first varistor part having a first principal face and a second principal face facing each other; a second varistor part comprising a second varistor element layer to exhibit nonlinear voltage-current characteristics, and a plurality of second internal electrodes juxtaposed in an extending direction of the second varistor element layer in the second varistor element layer, the second varistor part having a third principal face and a fourth principal face facing each other; and a heat dissipation layer having a fifth principal face and a sixth principal face facing each other, wherein the fifth principal face of the heat dissipation layer is in contact with the second principal face of the first varistor part and wherein the sixth principal face of the heat dissipation layer is in contact with the fourth principal face of the second varistor part.

In the aggregate substrate according to the present invention, the heat dissipation layer is sandwiched between the first varistor part and the second varistor part while being in contact with them. For this reason, warpage of the aggregate substrate is unlikely to occur. The use of the aggregate substrate according to the present invention facilitates production of varistors with high heat dissipation efficiency.

Preferably, the first varistor part further comprises a plurality of pairs of first surface electrodes formed on the first principal face, the second varistor part further comprises a plurality of pairs of second surface electrodes formed on the third principal face, each of the first surface electrodes in each pair is opposed at least in part to the corresponding first internal electrode, and each of the second surface electrodes in each pair is opposed at least in part to the corresponding second internal electrode.

More preferably, the aggregate substrate further comprises a plurality of first external electrodes each of which is electrically connected to one first surface electrode out of the first surface electrodes in each pair; and a plurality of second external electrodes each of which is electrically connected to the other first surface electrode out of the first surface electrodes in each pair.

Furthermore, preferably, the first varistor part further comprises a plurality of third internal electrodes, the second varistor part further comprises a plurality of fourth internal electrodes, each of the third internal electrodes is opposed to the corresponding first internal electrode in an opposing direction of the first principal face and the second principal face, and each of the fourth internal electrodes is opposed to the corresponding second internal electrode in the opposing direction of the first principal face and the second principal face.

More preferably, the aggregate substrate further comprises a plurality of first external electrodes electrically connected to the respective first internal electrodes, and a plurality of second external electrodes electrically connected to the respective second internal electrodes.

A production method of an aggregate substrate according to the present invention is a method comprising: a preparation step of preparing a first green sheet containing a varistor material, a second green sheet containing a varistor material and having a plurality of internal electrode patterns formed thereon, and a third green sheet containing a heat dissipation material; a laminating step of laminating the first to third green sheets prepared, to obtain a green laminated body having a first varistor green part, a second varistor green part, and a heat dissipation part; and a firing step of firing the green laminated body to obtain an aggregate substrate, wherein the laminating step comprises laying the third green sheet between a first portion made by at least laying the first green sheet on the second green sheet, and a second portion made by at least laying the first green sheet on the second green sheet, so as to be in contact with the first and second portions, thereby obtaining the green laminated body.

In the production method of the aggregate substrate according to the present invention, the third green sheet is sandwiched between the first and second portions, while being in contact with the first and second portions, in the green laminated body obtained. Therefore, it is feasible to suppress occurrence of warpage of the resultant aggregate substrate even if there is difference between contraction of the first and second green sheets and contraction of the third green sheet during firing the first to third green sheets.

Preferably, the preparation step comprises further preparing a fourth green sheet containing a varistor material and having a plurality of surface electrode patterns, and the laminating step comprises laying the fourth green sheet so that the plurality of surface electrode patterns are located on a surface of the green laminated body.

Preferably, the laminating step comprises laying at least two second green sheets so that the plurality of internal electrode patterns are opposed, in each of the first and second portions.

A varistor according to the present invention is a varistor comprising: a first varistor part having a first face and a second face facing each other; a second varistor part having a third face and a fourth face facing each other; a heat dissipation part located between the first and second varistor parts and being in contact with the second and fourth faces; and a pair of external electrodes arranged on the first varistor part, wherein the first varistor part comprises a first varistor element body to exhibit nonlinear voltage-current characteristics, a first internal electrode arranged in the first varistor element body, and a pair of first surface electrodes arranged on the first face and each opposed at least in part to the first internal electrode, wherein the second varistor part comprises a second varistor element body to exhibit nonlinear voltage-current characteristics, a second internal electrode arranged in the second varistor element body, and a pair of second surface electrodes arranged on the third face and each opposed at least in part to the second internal electrode, and wherein each external electrode is electrically connected to the corresponding first surface electrode.

Another varistor according to the present invention is a varistor comprising: a first varistor part having a first face and a second face facing each other; a second varistor part having a third face and a fourth face facing each other; a heat dissipation part located between the first and second varistor parts and being in contact with the second and fourth faces; and a pair of external electrodes arranged on the first varistor part, wherein the first varistor part comprises a first varistor element body to exhibit nonlinear voltage-current characteristics, and first and second internal electrodes arranged in the first varistor element body and opposed to each other in an opposing direction of the first and the second faces, wherein the second varistor part comprises a second varistor element body to exhibit nonlinear voltage-current characteristics, and third and fourth internal electrodes arranged in the second varistor element body and opposed to each other in an opposing direction of the third and the fourth faces, and wherein the pair of external electrodes are electrically connected to the first and the second internal electrodes, respectively.

Another aggregate substrate according to the present invention is an aggregate substrate comprising: a first varistor part comprising a first varistor element layer to exhibit nonlinear voltage-current characteristics, and a plurality of first internal electrodes juxtaposed in the first varistor element layer; a second varistor part comprising a second varistor element layer to exhibit nonlinear voltage-current characteristics, and a plurality of second internal electrodes juxtaposed in the second varistor layer; and a heat dissipation layer located between the first and second varistor parts and being in contact with the first and second varistor parts.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The best mode for carrying out the present invention will be described below in detail with reference to the accompanying drawings. In the description of the drawings the same elements will be denoted by the same reference symbols, without redundant description.

First Embodiment

Figure 1:
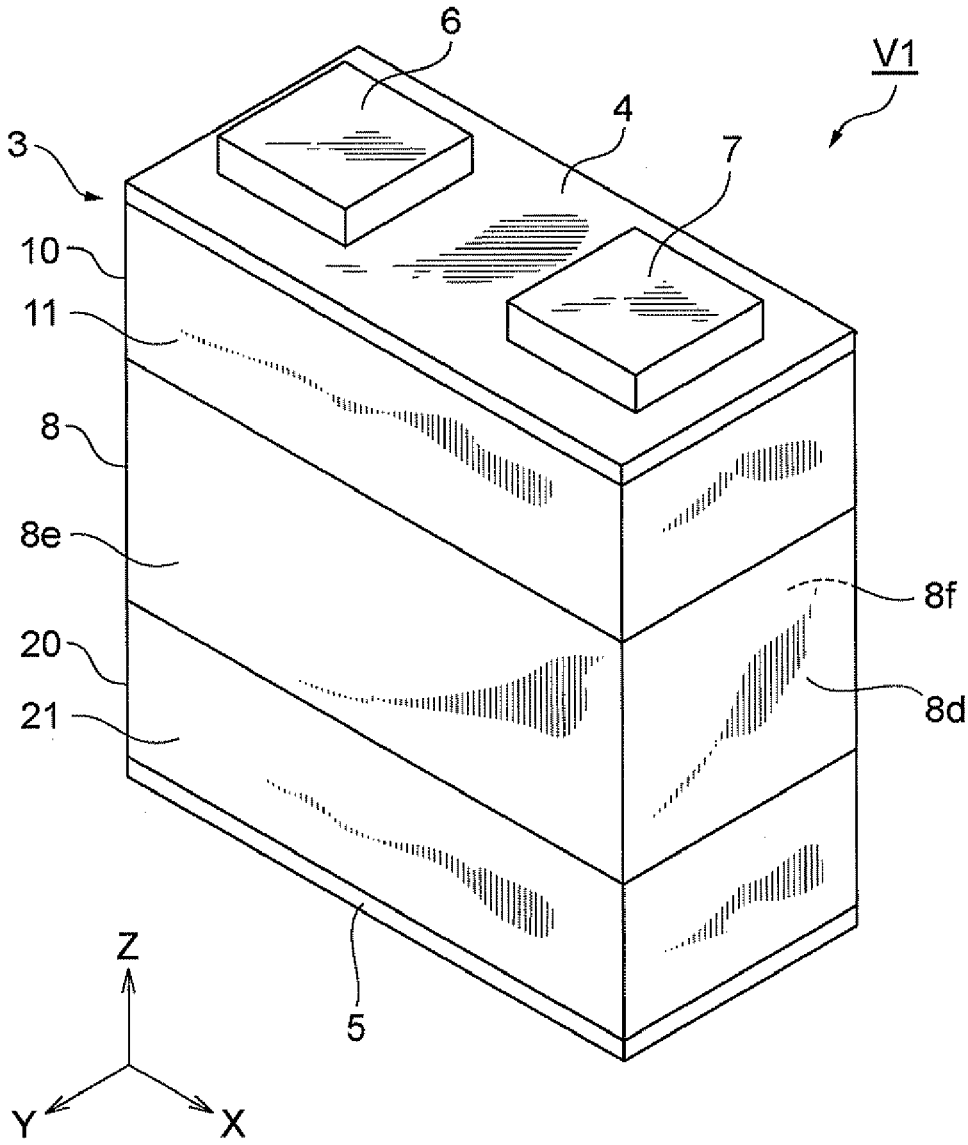
FIG. 1 is a schematic perspective view of a varistor according to the first embodiment.
Figure 2:
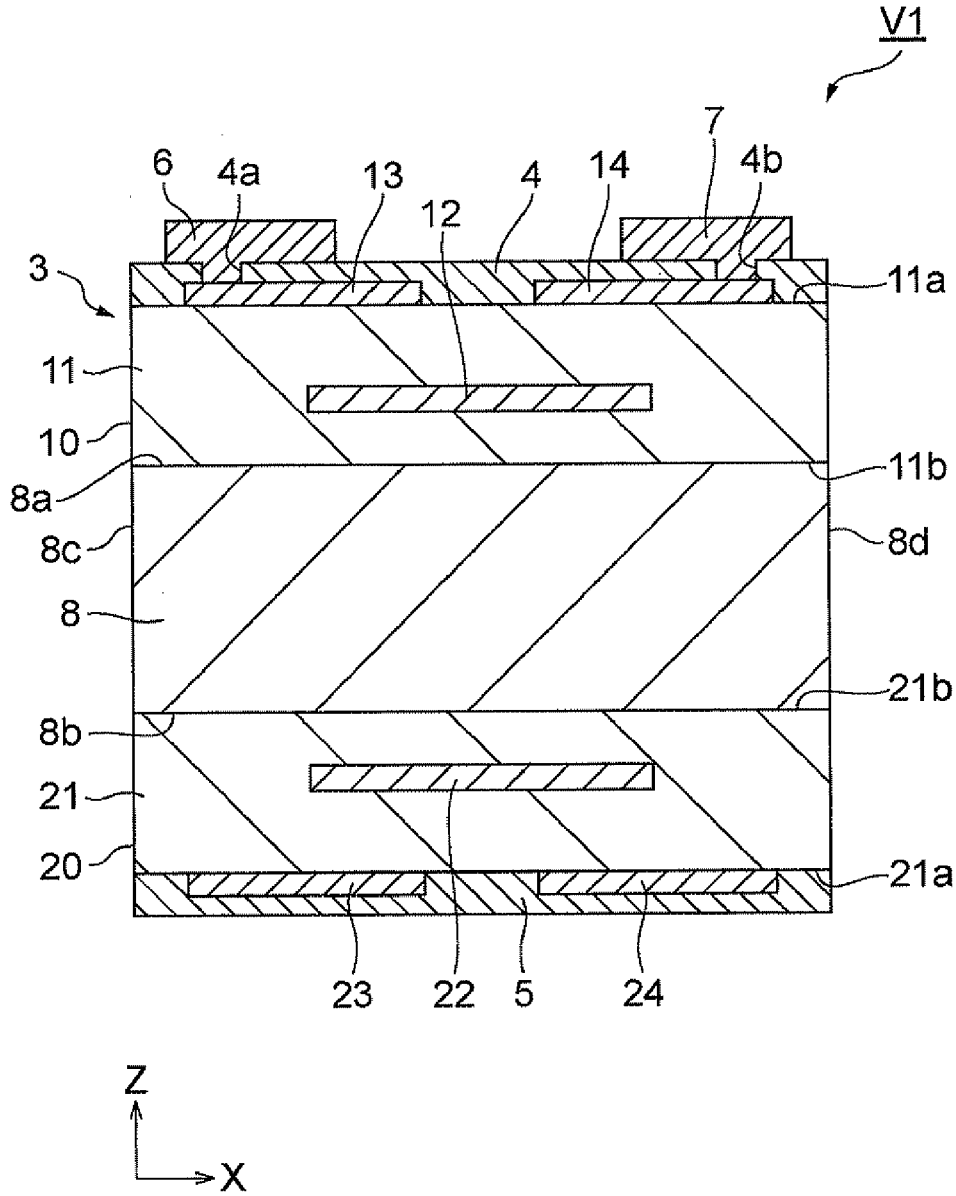
FIG. 2 is a schematic sectional view of the varistor according to the first embodiment.

FIG. 1 is a schematic perspective view of the varistor according to the first embodiment. FIG. 2 is a schematic sectional view of the varistor according to the first embodiment. As shown in FIGS. 1 and 2, the varistor V1 of the first embodiment has an element body 3 of a nearly rectangular parallelepiped shape, insulating layers 4, 5 formed on the top and bottom surfaces of the element body 3, and a pair of external electrodes 6, 7. The element body 3 has a heat dissipation part 8 of a nearly rectangular parallelepiped shape, and first and second varistor parts 10, 20 laid on the top and bottom surfaces of the heat dissipation part 8. The vertical direction of the element body 3 is defined as a Z-direction in an XYZ orthogonal coordinate system.

The first varistor part 10 includes a varistor element body 11, an internal electrode 12, and a pair of surface electrodes 13, 14. The varistor element body 11 is of a nearly rectangular parallelepiped shape and has faces 11*a* and 11*b* facing each other in the Z-direction. The varistor element body 11 is a laminated body formed by laminating a plurality of varistor layers in the Z-direction. Each varistor layer exhibits the nonlinear voltage-current characteristics and contains ZnO as a main component and Pr or Bi as an accessory component. The accessory component is present in the form of simple metal or oxide in the varistor layers. The varistor layers are integrally formed in practical varistor V1 so that no border can be visually recognized between the varistor layers.

The internal electrode 12 is a layer of a nearly rectangular shape and is arranged in an approximately central region in the varistor element body 11 so that its principal faces are parallel to the first face 11*a*. The pair of surface electrodes 13, 14 are layers of a nearly rectangular shape and are arranged in juxtaposition in the X-direction on the face 11*a* of the varistor element body 11. The pair of surface electrodes 13, 14 are arranged apart from each other and electrically isolated from each other. A portion on the surface electrode 14 side in the surface electrode 13 and a portion on the surface electrode 13 side in the surface electrode 14 are opposed to the internal electrode 12 in the Z-direction.

The second varistor part 20 includes a varistor element body 21, an internal electrode 22, and a pair of surface electrodes 23, 24. The varistor element body 21 is of a nearly rectangular parallelepiped shape and has faces 21*a* and 21*b* facing each other in the Z-direction.

The varistor element body 21 is a laminated body formed by laminating a plurality of varistor layers in the Z-direction as the varistor element body 11 is. The internal electrode 22 is a layer of a nearly rectangular shape and is arranged in an approximately central region in the varistor element body 21 so that its principal faces are parallel to the first face 21*a*. The pair of surface electrodes 23, 24 are layers of a nearly rectangular shape and are arranged in juxtaposition in the X-direction on the face 21*a* of the varistor element body 21. A portion on the surface electrode 24 side in the surface electrode 23 and a portion on the surface electrode 23 side in the surface electrode 24 are opposed to the internal electrode 22 in the Z-direction.

The heat dissipation part 8 is of a nearly rectangular parallelepiped shape and has faces 8*a* and 8*b* facing each other in the Z-direction. The heat dissipation part 8 has a pair of side faces 8*c*, 8*d* facing each other in the X-direction and a pair of side fades 8*e*, 8*f* facing each other in the Y-direction. The face 8*a* of the heat dissipation part 8 is in contact with the face 11*b* in the first varistor part 10. The face 8*b* of the heat dissipation part 8 is in contact with the face 21*b* in the second varistor part 20.

The heat dissipation part 8 is made of a composite material of metal and metal oxide. Examples of the metal applicable herein include Ag, Ag—Pd, Pd, and so on and the metal is preferably Ag in terms of thermal conductivity. Examples of the metal oxide applicable herein include $Al_2O_3$, ZnO, $SiO_2$, and $ZrO_2$. The heat dissipation part 8 may be made of particles obtained by coating particles of metal oxide with metal. For example, it is possible to use particles obtained by plating particles of $Al_2O_3$ with Ag by electroless deposition.

Since the heat dissipation part 8 contains Ag which is metal, heat dissipation paths are established between the face 8*a* in contact with the first varistor part 10 and the side faces 8*c*-8*f*. Therefore, heat in the first varistor part 10 is efficiently dissipated from the side faces 8*c*-8*f* of the heat dissipation part 8. The first varistor part 10 and the second varistor part 20 are arranged in symmetry with respect to the heat dissipation part 8.

The insulating layer 4 is arranged so as to cover the face 11*a* of the varistor element body 11 and the pair of surface electrodes 13, 14 in the element body 3. The insulating layer 5 is arranged so as to cover the face 21*a* of the varistor element body 21 and the pair of surface electrodes 23, 24 in the element body 3. The insulating layers 4, 5 are made of polyimide. The insulating layer 4 is provided with apertures 4*a*, 4*b* which are formed at positions corresponding to the pair of surface electrodes 13, 14, respectively. This makes the surfaces of the pair of surface electrodes 13, 14 exposed in part from the insulating layer 4.

Figure 3:
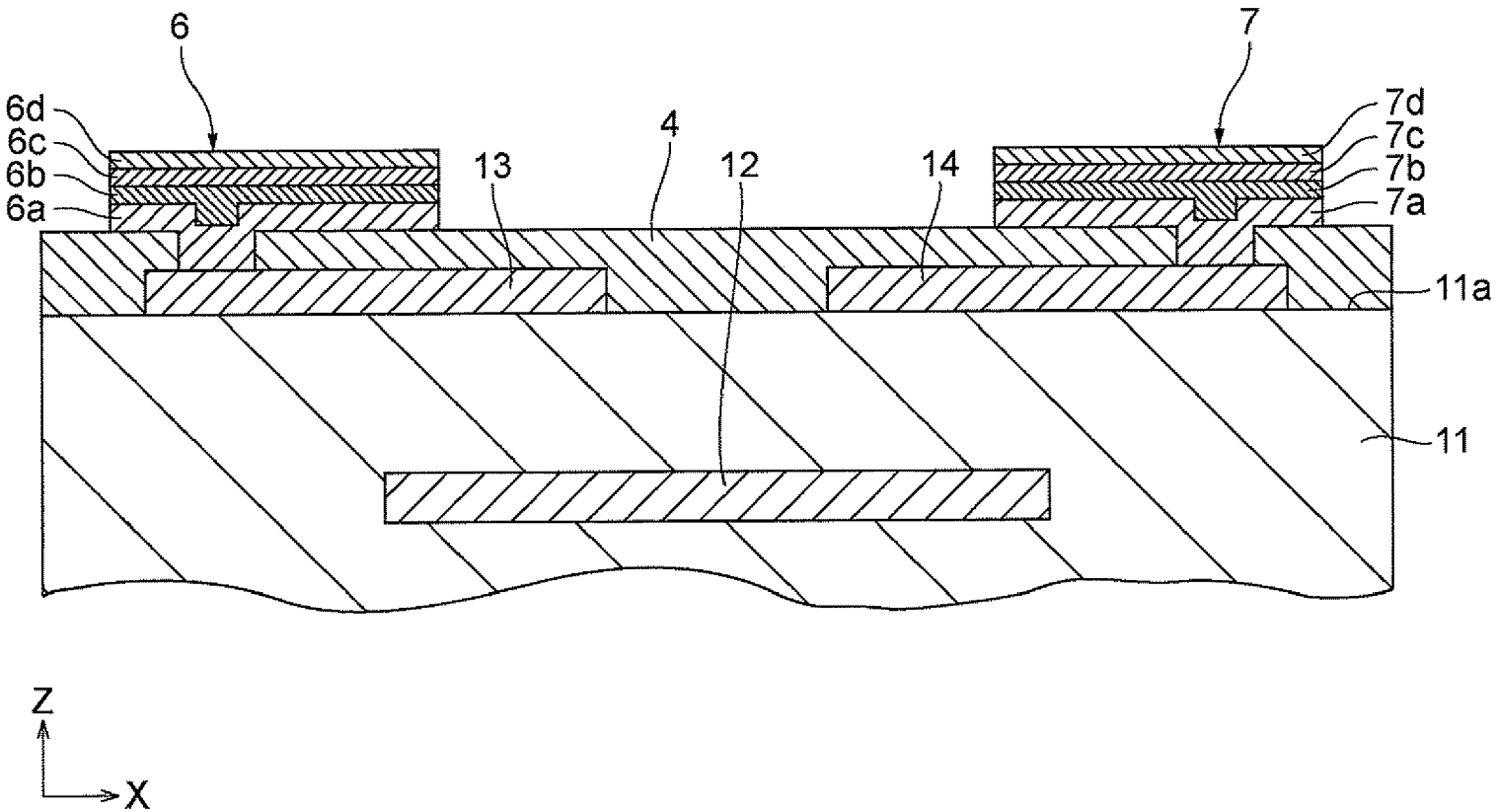
FIG. 3 is a partly enlarged view of the varistor shown in FIG. 2.

The pair of external electrodes 6, 7 are arranged in juxtaposition and apart from each other in the X-direction on the insulating layer 4. The external electrode 6 covers the aperture 4*a* of the insulating layer 4 and extends into the aperture 4*a* to come into physical contact with the surface electrode 13 so as to be electrically connected thereto. The external electrode 7 covers the aperture 4*b* of the insulating layer 4 and extends into the aperture 4*b* to come into physical contact with the surface electrode 14 so as to be electrically connected thereto. Each of the external electrodes 6, 7, as shown in FIG. 3, is composed of four layers of Cr layer 6*a*, 7*a*, Cu layer 6*b*, 7*b*, Ni layer 6*c*, 7*c*, and Au layer 6*d*, 7*d*. This pair of external electrodes 6, 7 function as connecting terminals to an electronic device (e.g., a semiconductor light emitting device or the like).

Figure 4:
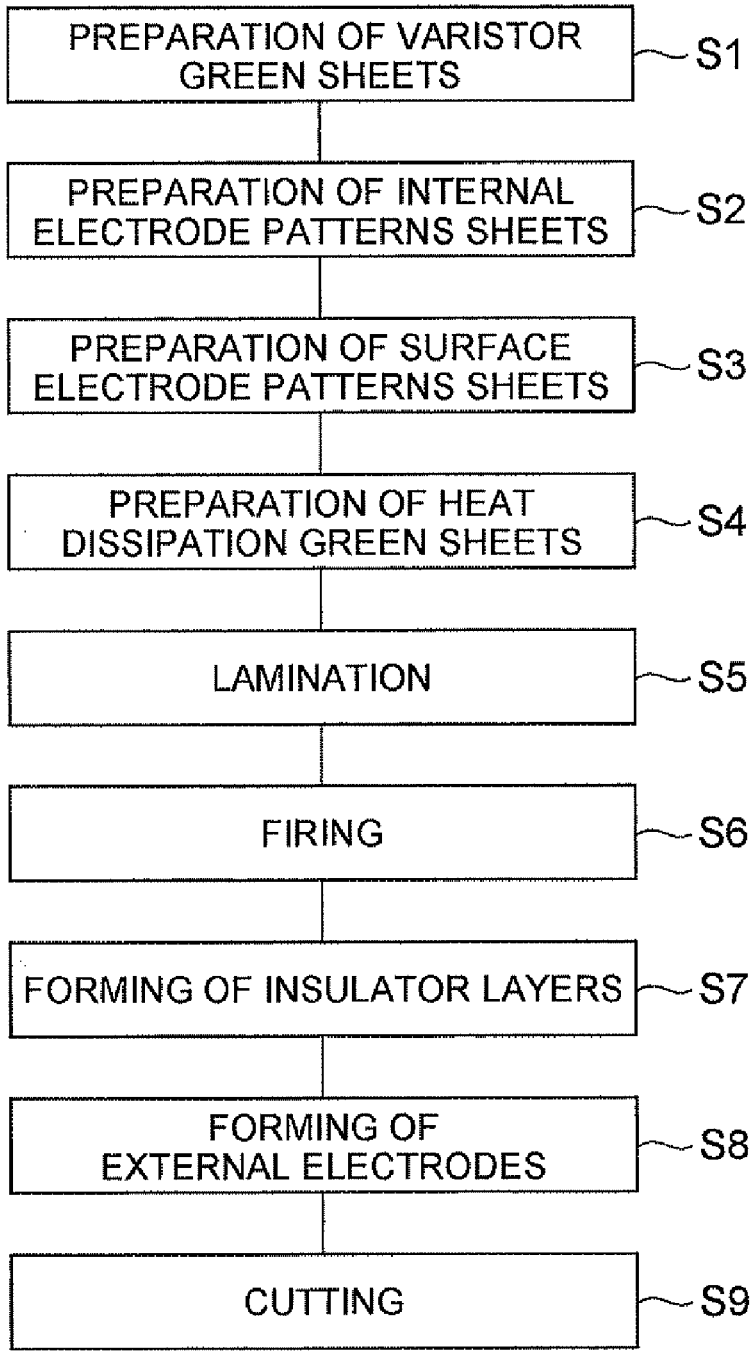
FIG. 4 is a flowchart showing production steps of the varistor according to the first embodiment.

Next, a production process of the above-described varistor V1 will be described. The production process of the varistor V1 involves first producing an aggregate substrate. A production method of this aggregate substrate, as shown in FIG. 4, includes a preparation step S1 of varistor green sheets, a preparation step S2 of internal electrode pattern sheets, a preparation step S3 of surface electrode pattern sheets, a preparation step S4 of heat dissipation green sheets, a laminating step S5, and a firing step S6. Each of these steps will be described below.

The preparation step S1 of varistor green sheets is to prepare a predetermined number of varistor green sheets to become varistor layers. First, a varistor material of powder is prepared by mixing ZnO as a main component of the varistor element bodies 11, 21, and metals or oxides of Pr, Co, Cr, Ca, Si, Bi, etc. as accessory components, at a predetermined ratio. Thereafter, an organic binder, an organic solvent, an organic plasticizer, etc. are added into this varistor material to obtain a slurry. This slurry is applied onto film and thereafter dried to obtain varistor green sheets.

The preparation step S2 of internal electrode pattern sheets is to form a plurality of internal electrode patterns on two varistor green sheets. An internal electrode pattern formed on one varistor green sheet out of the two becomes the internal electrode 12 and an internal electrode pattern formed on the other varistor green sheet becomes the internal electrode 22. The internal electrode patterns are formed by printing an electroconductive paste obtained by mixing an organic binder and an organic solvent in a metal powder consisting primarily of Ag particles, onto the varistor green sheets and drying it.

The preparation step S3 of surface electrode pattern sheets is to form plural pairs of surface electrode patterns on two varistor green sheets. Each of the plural pairs of surface electrode patterns formed on one varistor green sheet becomes the surface electrodes 13, 14 and each of the plural pairs of surface electrode patterns formed on the other varistor green sheet becomes the surface electrodes 23, 24. The surface electrode patterns can be formed with the same electroconductive paste and in the same manner as the internal electrode patterns.

The preparation step S4 of heat dissipation green sheets is to prepare a predetermined number of heat dissipation green sheets to constitute the heat dissipation part 8. First, a heat dissipation material (e.g., Ag powder) is mixed in the aforementioned varistor material and an organic binder, an organic solvent, an organic plasticizer, etc. are added therein to obtain a slurry. This slurry is applied onto film and then dried to obtain heat dissipation green sheets. The above preparation steps result in preparing the predetermined numbers of varistor green sheets, internal electrode pattern sheets, surface electrode pattern sheets, and heat dissipation green sheets.

The subsequent laminating step S5 is to laminate the varistor green sheets, internal electrode pattern sheets, surface electrode pattern sheets, and heat dissipation green sheets to form a green laminated body. Specifically, the green laminated body shown in FIGS. 5 and 6 (*a*) is made by laminating the varistor green sheets with neither of the internal electrode patterns and the surface electrode patterns, the varistor green sheets with the internal electrode patterns thereon, the varistor green sheets with the surface electrode patterns thereon, and the heat dissipation green sheets in a predetermined order, pressing them, and cutting the laminate in the lamination direction (Z-direction).

Figure 5:
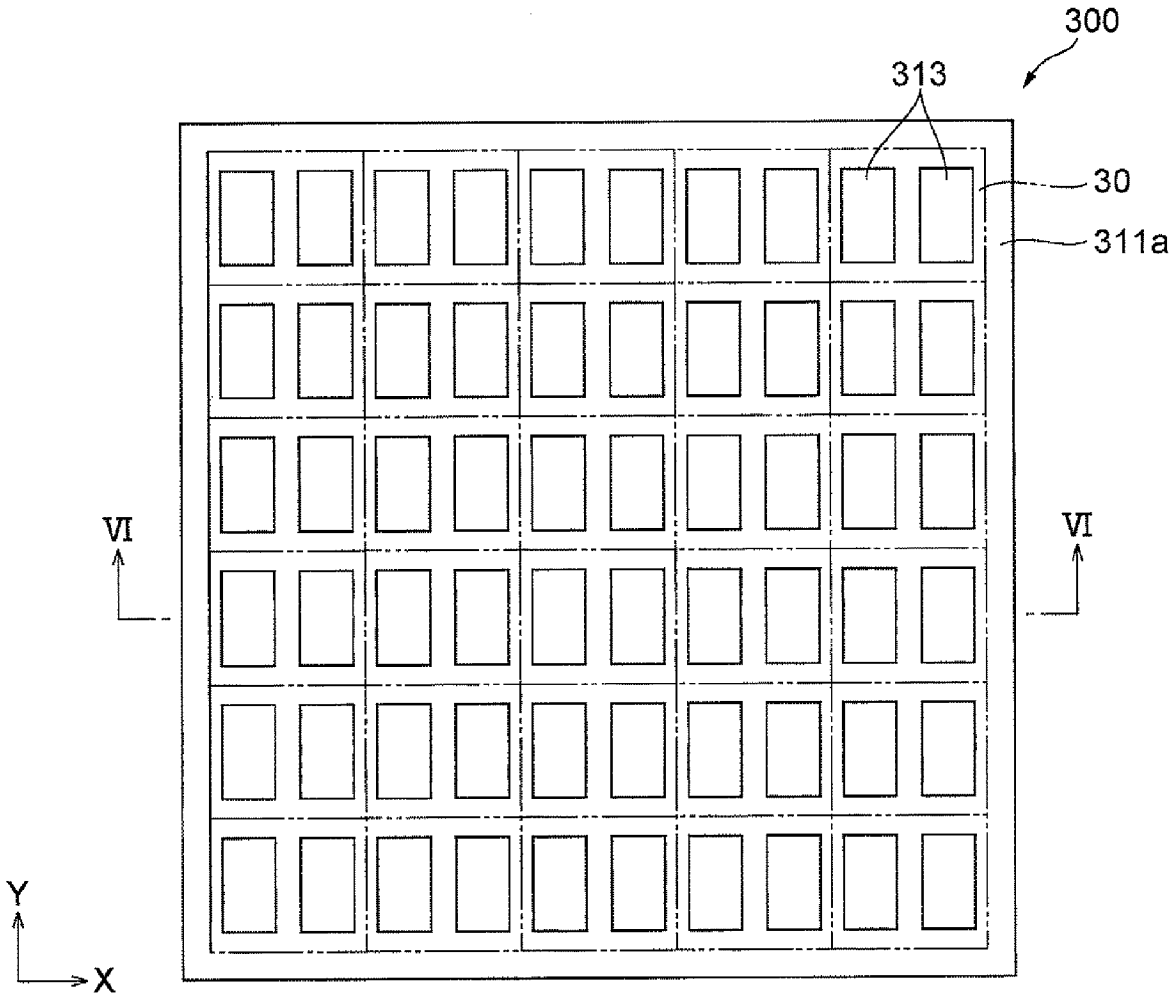
FIG. 5 is a schematic plan view of a green laminated body according to the first embodiment.
Figure 6:
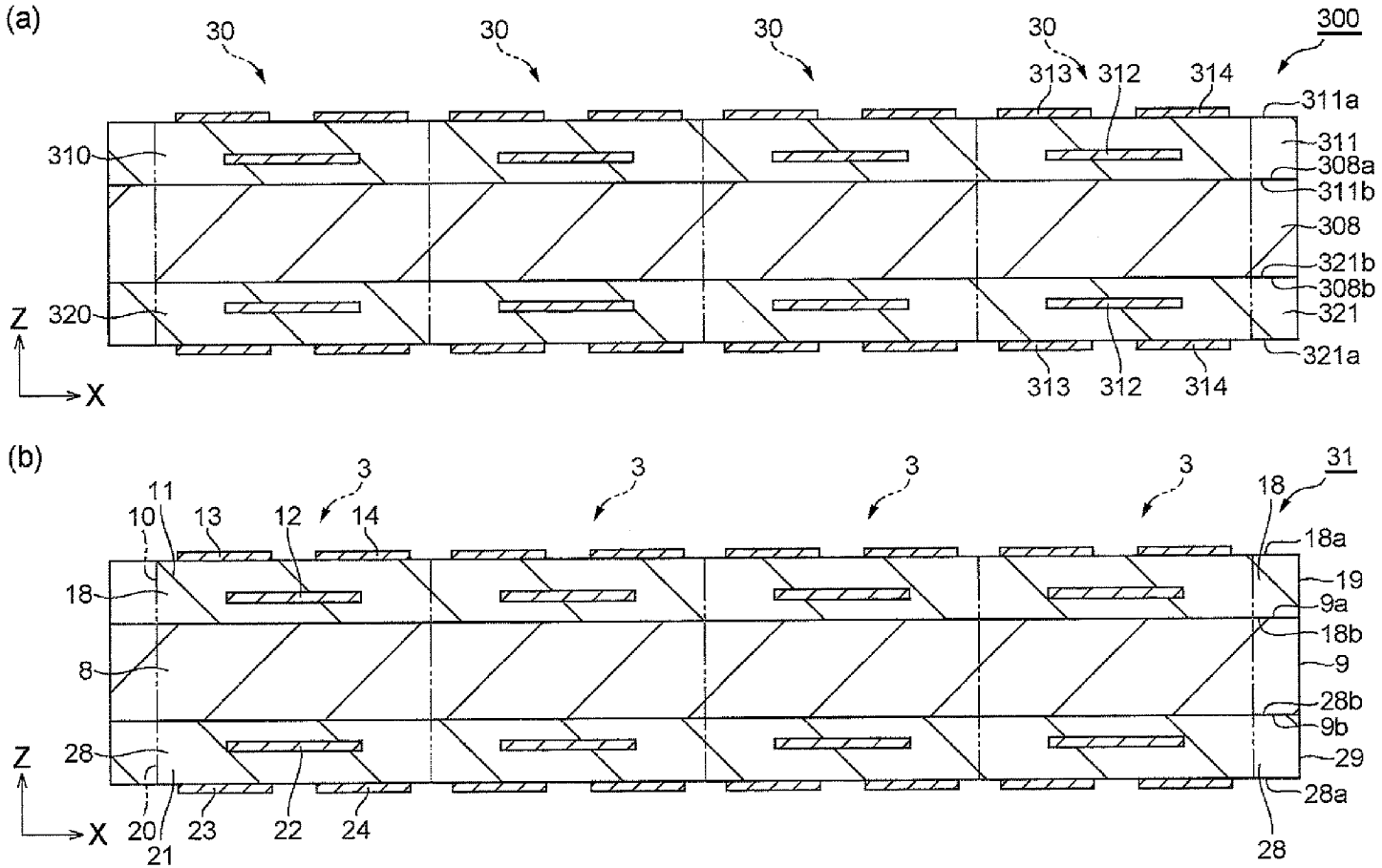
FIG. 6 is schematic sectional views of the green laminated body and an aggregate substrate according to the first embodiment.

FIG. 5 is a schematic plan view of the green laminated body and FIG. 6(*a*) a schematic sectional view of the green laminated body. The green laminated body 300 contains a plurality of green element assemblies 30 to become element assemblies 3 after fired. FIGS. 5 and 6 show the green laminated body 300 containing thirty green element assemblies arranged in a matrix of five columns in the X-direction and six rows in the Y-direction, for convenience' sake of illustration, but a practical green laminated body 300 contains a larger number of green element assemblies 30.

The green laminated body 300 has a heat dissipation green part 308 to become the heat dissipation part 8, a first varistor green part 310 to become the first varistor part 10, and a second varistor green part 320 to become the second varistor part 20.

The first varistor green part 310 is formed by laminating a varistor green sheet with a plurality of internal electrode patterns 312, a varistor green sheet with plural pairs of surface electrode patterns 313, 314, and varistor green sheets without any electrode pattern in a predetermined order in the Z-direction. This leads the first varistor green part 310 to have a varistor green layer 311, a plurality of internal electrode patterns 312, and plural pairs of surface electrode patterns 313, 314.

The varistor green layer 311 is composed of a lamination of varistor green sheets and has a principal face 311*a* and a principal face 311*b* facing each other in the Z-direction. The plurality of internal electrode patterns 312 are arranged in the varistor green layer 311 and are juxtaposed in extending directions of the varistor green sheets (the X-direction and Y-direction).

The varistor green sheet constituting the principal face 311*a* of the varistor green layer 311 is the one with plural pairs of surface electrode patterns 313, 314 thereon. This allows the plural pairs of surface electrode patterns 313, 314 to be arranged on the principal face 311*a* of the varistor green layer 311. These plural pairs of surface electrode patterns 313, 314 are arranged so that a pair of surface electrode patterns 313, 314 are opposed each to one internal electrode pattern 312. These surface electrode patterns 313, 314 are located on a surface of the green laminated body 300.

The second varistor green part 320 is formed by laminating a varistor green sheet with a plurality of internal electrode patterns 312 thereon, a varistor green sheet with plural pairs of surface electrode patterns 313, 314 thereon, and varistor green sheets without any electrode pattern in a predetermined order in the Z-direction. This leads the second varistor green part 320 to have a varistor green layer 321, a plurality of internal electrode patterns 312, and plural pairs of surface electrode patterns 313, 314. These surface electrode patterns 313, 314 are also located on a surface of the green laminated body 300.

The varistor green layer 321 is composed of a lamination of varistor green sheets and has a principal face 321*a* and a principal face 321*b* facing each other in the Z-direction. The plurality of internal electrode patterns 312 are arranged in the varistor green layer 321 and juxtaposed in the extending directions of the varistor green sheets (the X-direction and Y-direction).

The varistor green sheet constituting the principal face 321*a* of the varistor green layer 321 is the one with plural pairs of surface electrode patterns 313, 314 thereon. This allows the plural pairs of surface electrode patterns 313, 314 to be arranged on the principal face 321*a* of the varistor green layer 321. These pairs of surface electrode patterns 313, 314 are arranged so that a pair of surface electrode patterns 313, 314 are opposed each to one internal electrode pattern 312.

The heat dissipation green part 308 is formed by laminating the heat dissipation green sheets in the Z-direction, and has a principal face 308*a* and a principal face 308*b* facing each other in the Z-direction. The principal face 308*a* of the heat dissipation green part 308 is in contact with the principal face 311*b* of the first varistor green part 310. Furthermore, the principal face 308*b* of the heat dissipation green part 308 is in contact with the principal face 321*b* of the second varistor green part 320. The first varistor green part 310 and the second varistor green part 320 are arranged in symmetry with respect to the heat dissipation green part 308.

The next firing step S6 is to perform a debindering process of the resultant green laminated body 300. The green laminated body 300 is heated, for example, at the temperature of 180° C.-400° C. and for about 0.5 hour to 24 hours, so as to be debindered. After completion of the debindering process of the green laminated body 300, it is fired at the temperature of not less than 800° C. in an $O_2$ atmosphere to form an aggregate substrate 31 shown in FIG. 6(*b*).

The aggregate substrate 31 has a heat dissipation layer 9 made by firing of the heat dissipation green part 308, a first varistor part 19 made by firing of the first varistor green part 310, and a second varistor part 29 made by firing of the second varistor green part 320.

The first varistor part 19 includes a varistor element layer 18 made by firing of the varistor green layer 311, a plurality of internal electrodes 12 made by firing of the plurality of internal electrode patterns 312, and plural pairs of surface electrodes 13, 14 made by firing of the plural pairs of surface electrode patterns 313, 314. The varistor element layer 18 has a principal face 18*a* made by firing of the varistor green layer 311, and a principal face 18*b* made by firing of the varistor green layer 311.

The second varistor part 29 includes a varistor element layer 28 made by firing of the varistor green layer 321, a plurality of internal electrodes 22 made by firing of the plurality of internal electrode patterns 312, and surface electrodes 23, 24 made by firing of the surface electrode patterns 313, 314. The varistor element layer 28 has a principal face 28*a* made by firing of the varistor green layer 321, and a principal face 28*b* made by firing of the varistor green layer 321.

The heat dissipation layer 9 has a principal face 9*a* made by firing of the heat dissipation green part 308, and a principal face 9*b* made by firing of the heat dissipation green part 308. The heat dissipation green sheets and the varistor green sheets contain the common component ZnO. Since the debindering and firing are carried out in the state in which the principal face 308*a* of the heat dissipation green part 308 is in contact with the principal face 311*b* of the first varistor green part 310, the heat dissipation layer 9 and the first varistor part 19 are more firmly joined together. Similarly, since the debindering and firing are carried out in the state in which the principal face 308*b* of the heat dissipation green part 308 is in contact with the principal face 321*b* of the second varistor green part 320, the heat dissipation layer 9 and the second varistor part 29 are more firmly joined together. The first varistor part 19 and the second varistor part 29 are arranged in symmetry with respect to the heat dissipation layer 9.

There is difference between contraction caused by firing of the heat dissipation green part 308 and contraction caused by firing of the first and second varistor green parts 310, 320. However, since the heat dissipation green part 308 is sandwiched between the first varistor green part 310 and the second varistor green part 320 with the first varistor green part 310 being in contact with the principal face 308*a* of the heat dissipation green part 308 and with the second varistor green part 320 being in contact with the principal face 308*b* of the heat dissipation green part 308, the aggregate substrate 31 of planar shape can be formed while preventing occurrence of warpage during the firing.

After the aggregate substrate 31 is formed through the above steps, an insulating layer forming step S7 and an external electrode forming step S8 are carried out to produce an aggregate substrate with external electrodes. The insulating layer forming step S7 and the external electrode forming step S8 will be described with reference to FIGS. 7 to 10. FIGS. 7 to 10 show only a part corresponding to one element body 3 in the aggregate substrate 31, for convenience sake of illustration, but it should be noted that the whole aggregate substrate 31 is subjected to the same processing in fact.

Figure 7:
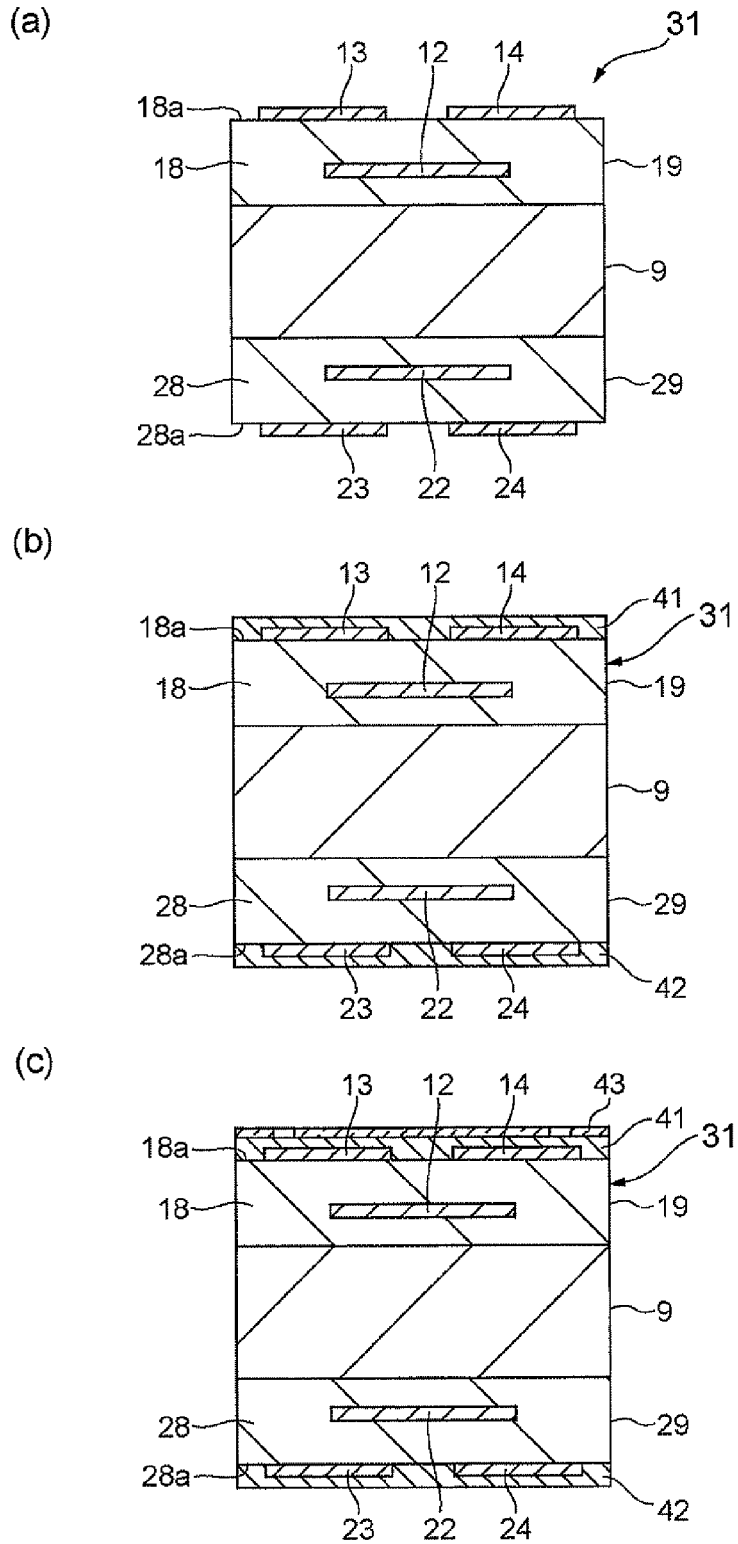
FIG. 7 is a drawing showing a procedure of forming insulator layers in the varistor according to the first embodiment.

First, the insulating layer forming step S7 includes forming an insulating layer on each of the principal face 18*a* of the first varistor part 19 and the principal face 28*a* of the second varistor part 29 shown in FIG. 7(*a*). As shown in FIG. 7(*b*), a raw solution of photosensitive polyimide is applied onto the principal face 18*a* of the first varistor part 19 and onto the principal face 28*a* of the second varistor part 29 by spin coating, and then precured and dried to form precured polyimide layers 41, 42.

Figure 8:
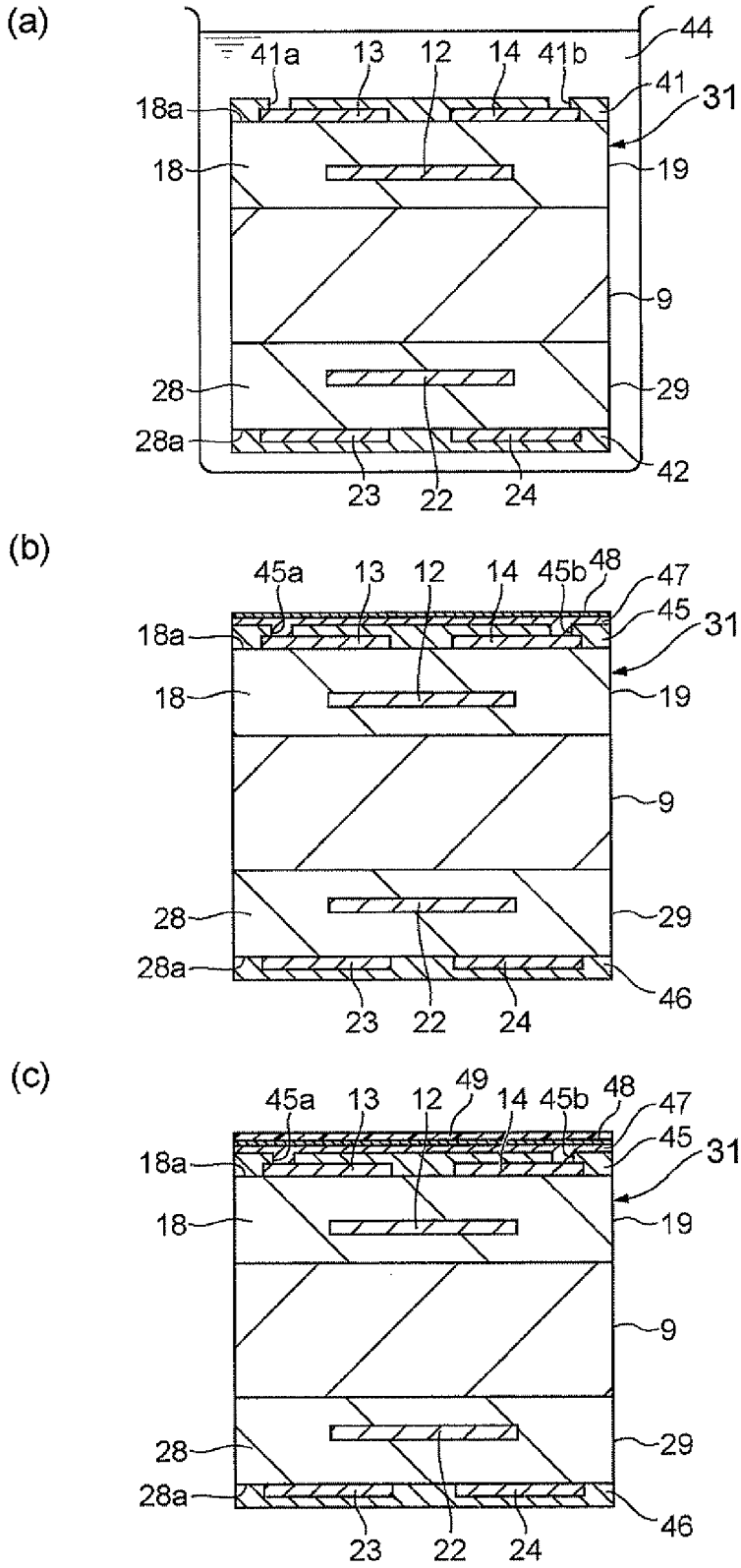
FIG. 8 is a drawing showing a procedure of forming the insulator layers and external electrodes in the varistor according to the first embodiment.

Next, as shown in FIG. 7(*c*), a negative mask 43 of glass is placed on the polyimide layer 41, in order to form apertures in the polyimide layer 41 formed on the principal face 18*a*, and exposure is performed. Subsequently, as shown in FIG. 8(*a*), the entire aggregate substrate 31 is immersed in a Na-base aqueous solution 44 to effect development, thereby forming apertures 41*a*, 41*b*. The surface electrodes 13, 14 are exposed in part through the apertures 41*a*, 41*b*. The apertures 41*a*, 41*b* correspond to the apertures 4*a*, 4*b* of the varistor V1.

Thereafter, the substrate is washed with pure water and then the polyimide layers 41, 42 are subjected to main curing/drying, thereby forming insulating layers 45, 46, as shown in FIG. 8(*b*). The above process forms the insulating layers 45, 46 to become the insulating layers 4, 5.

The external electrode forming step S8 is to form plural pairs of external electrodes 6, 7. First, as shown in FIG. 8(*b*), a Cr layer 47, which covers the insulating layer 45, and the exposed portions of the surface electrodes 13, 14 exposed from the apertures 45*a*, 45*b* of the insulating layer 45, is formed by sputtering. Subsequently, a Cu layer 48 is formed on the Cr layer 47 by sputtering. Then, as shown in FIG. 8(*c*), dry film 49 is pasted onto the Cu layer 48.

Figure 9:
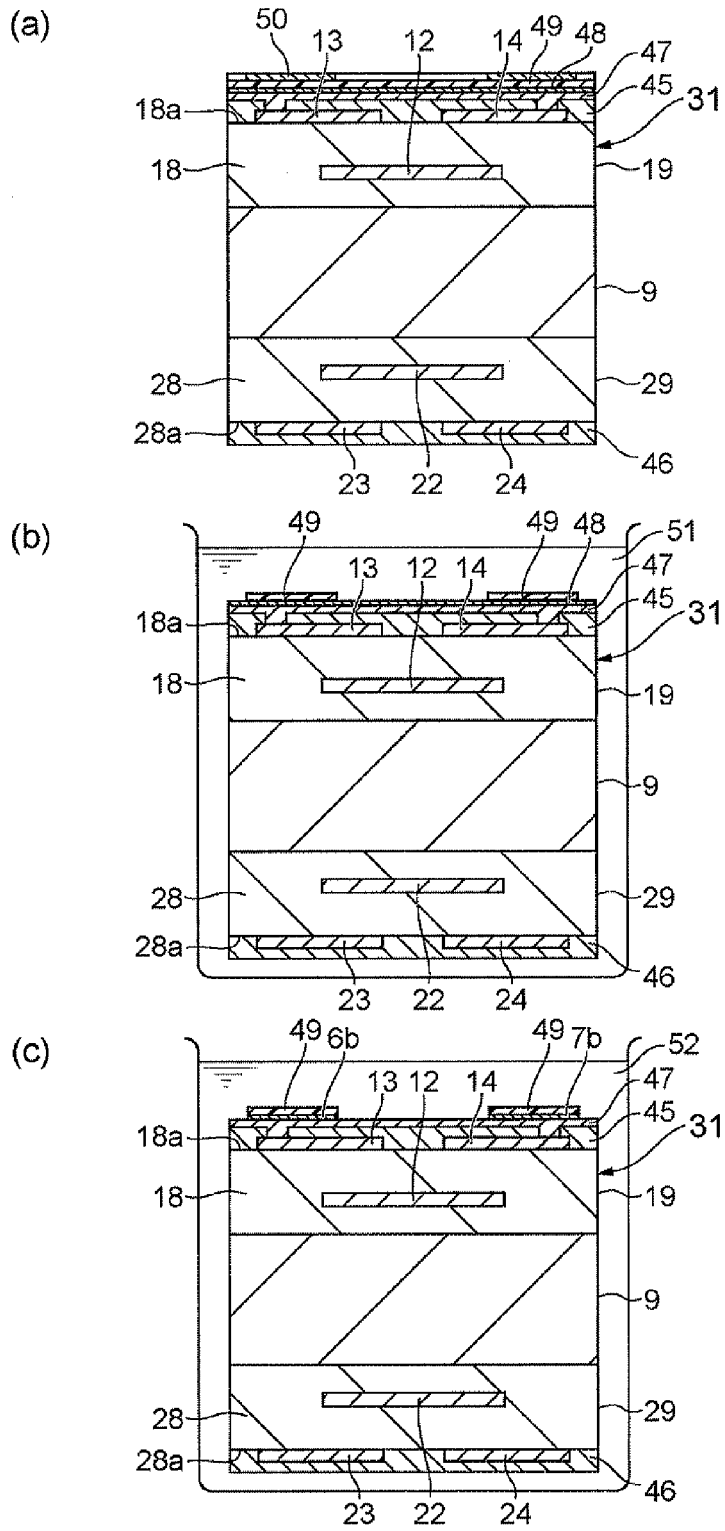
FIG. 9 is a drawing showing a procedure of forming the external electrodes in the varistor according to the first embodiment.

As shown in FIG. 9(*a*), a mask 50 corresponding to the shape of the external electrodes 6, 7 is placed on the dry film 49 and exposure is performed. Subsequently, as shown in FIG. 9(*b*), the aggregate substrate 31 is immersed in a developer solution 51 to effect development, whereby the dry film 49 is shaped corresponding to the shape of the external electrodes 6, 7. After the development, as shown in FIG. 9(*c*), the aggregate substrate 31 is immersed in an etching solution 59 to etch the Cu layer 48 to form Cu layers 6*b*, 7*b*, followed by washing with pure water.

Figure 10:
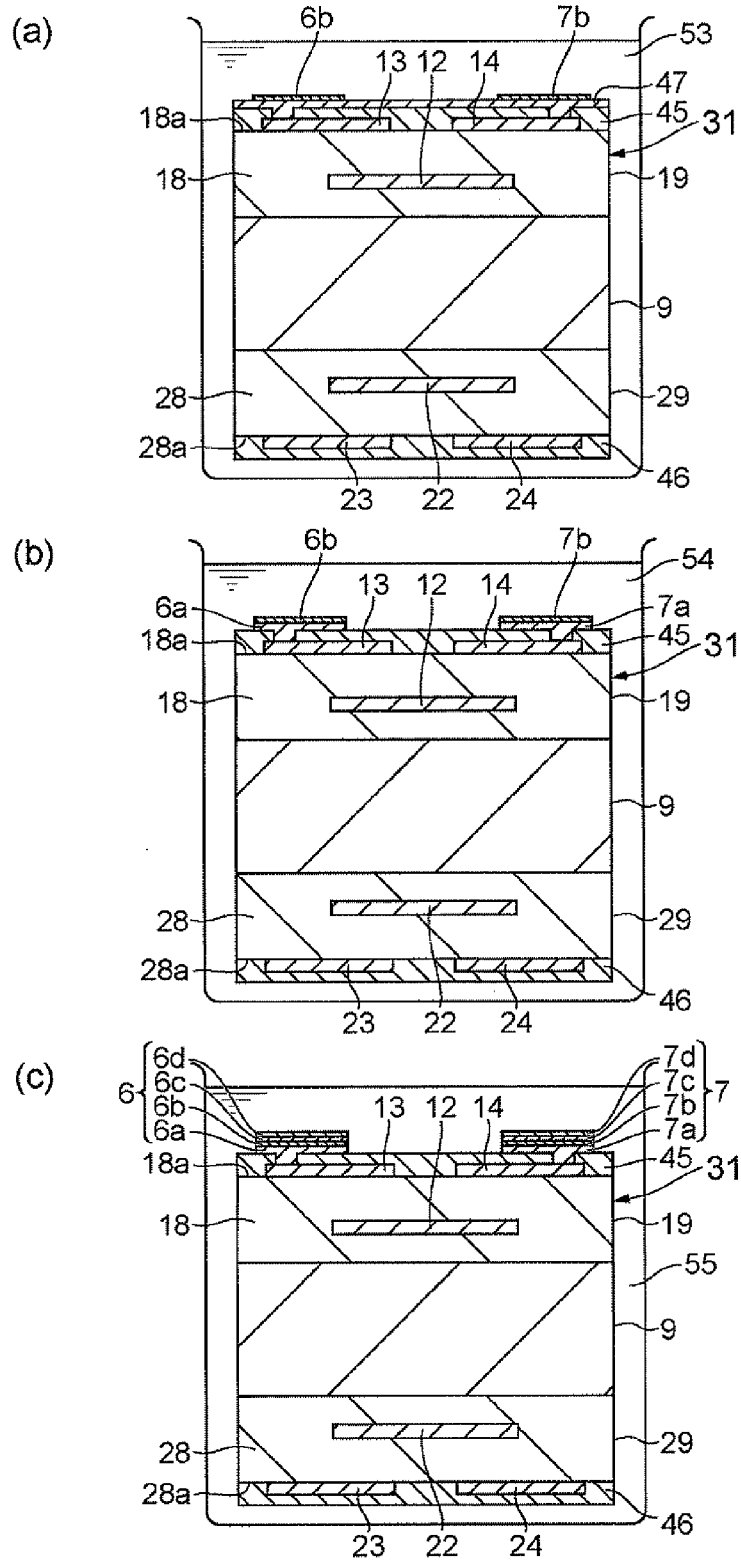
FIG. 10 is a drawing showing a procedure of forming the external electrodes in the varistor according to the first embodiment.

Subsequently, as shown in FIG. 10(*a*), the aggregate substrate 31 is immersed in a remover solution 53 to remove the dry film 49. Then, as shown in FIG. 10(*b*), the aggregate substrate 31 is immersed in an etching solution 54 to etch the Cr layer 47, thereby forming Cr layers 6*a*, 7*a*. Thereafter, the aggregate substrate 31 is washed with pure water and then dried.

Thereafter, the surfaces of the Cu layers 6*b*, 7*b* are plated with Ni to form Ni layers 6*c*, 7*c*, and then the aggregate substrate is immersed in a plating solution 55 to effect flash plating, thereby forming Au layers 6*d*, 7*d*. This step results in forming the external electrodes 6, 7 composed of the Cr layer 6*a*, 7*a*, Cu layer 6*b*, 7*b*, Ni layer 6*c*, 7*c*, and Au layer 6*d*, 7*d*.

Figure 11:
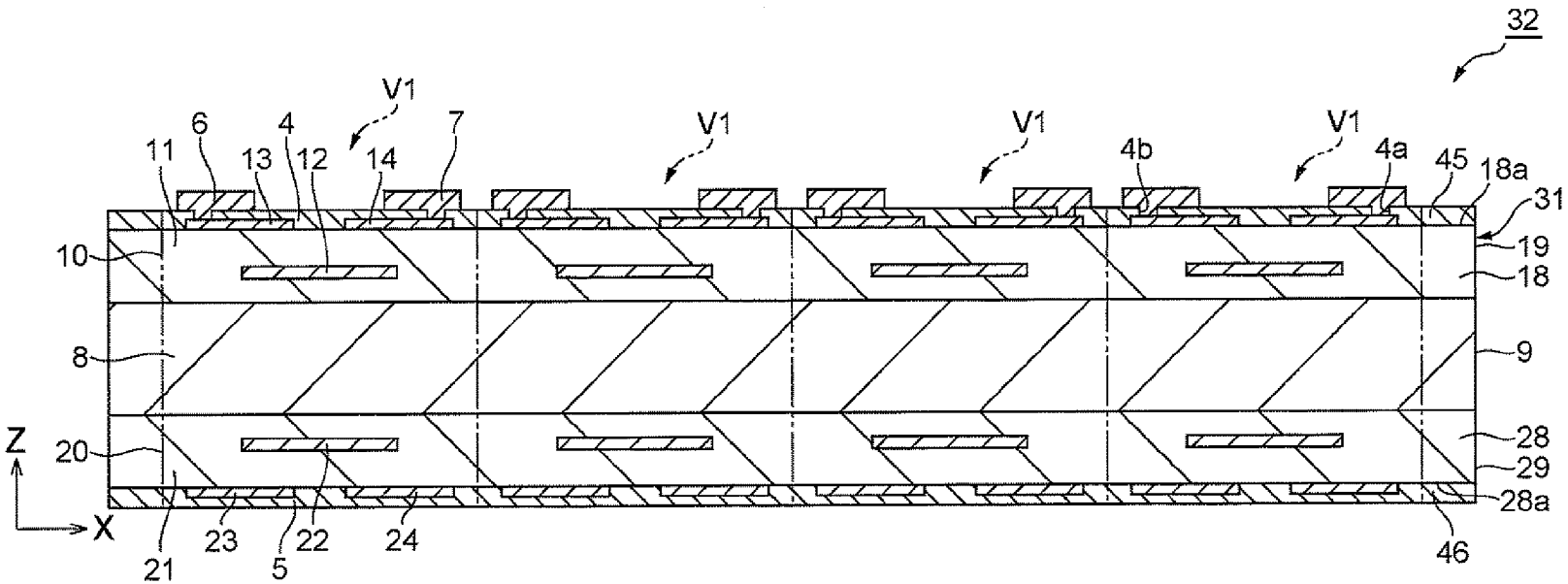
FIG. 11 is a schematic sectional view of an aggregate substrate with external electrodes according to the first embodiment.

The aggregate substrate 32 with external electrodes shown in FIG. 11 is obtained through the above steps. The aggregate substrate 32 with external electrodes has the aggregate substrate 32, the insulating layers 45, 46, and plural pairs of external electrodes 6, 7. The insulating layers 45, 46 correspond to the insulating layers 4, 5, respectively. The aggregate substrate 32 with external electrodes is then cut to obtain a plurality of varistors V1 (cutting step S9).

In the varistors V1 formed as described above, the heat dissipation part 8 contains ZnO being the main component of the varistor element bodies 11, 21. During the firing, Ag in the heat dissipation part 8 diffuses into grain boundaries of ZnO in the varistor element bodies 11, 21 near the interface between the face 11*b* and the face 8*a* and near the interface between the face 21*b* and the face 8*b*. This leads the first varistor part 10 and the heat dissipation part 8 to be firmly joined together and the second varistor part 20 and the heat dissipation part 8 to be firmly joined together.

In the varistors V1, therefore, there is little cracking between the first varistor part 10 and the heat dissipation part 8 and between the second varistor part 20 and the heat dissipation part 8 during the firing (or during the debindering), which ensures sufficient joint strength between the first varistor part 10 and the heat dissipation part 8 and sufficient joint strength between the second varistor part 20 and the heat dissipation part 8. Therefore, heat transferred from an electronic device through the external electrodes 6, 7 to the first varistor part 10 is efficiently dissipated through conduction paths formed from the face 8*a* to the side faces 8*c*-8*f* in the heat dissipation part 8 by Ag particles and coating portions of $Al_2O_3$.

In the production process of the varistors V1, the first and second varistor parts 10, 20 and the heat dissipation part 8 are simultaneously fired. This realizes simplification of the production process and achieves improvement in production efficiency of the varistors V1 and reduction of cost thereof.

There is the difference due to the difference of composition between the contraction caused by firing of the heat dissipation green part 308 (heat dissipation part 8) and the contraction caused by the firing of the first and second varistor green parts 310, 320 (first varistor part 10 and second varistor part 20). However, since the heat dissipation green part 308 is sandwiched between the first varistor green part 310 and the second varistor green part 320 with the first varistor green part 310 being in contact with the principal face 308*a* of the heat dissipation green part 308 and with the second varistor green part 320 being in contact with the principal face 308*b* of the heat dissipation green part 308, the aggregate substrate 31 of planar shape can be formed while suppressing occurrence of warpage during the firing. Since the individual varistors V1 are obtained by forming the external electrodes 6, 7 on the planar aggregate substrate 31 and cutting it, the plurality of varistors V1 with good heat dissipation efficiency can be readily produced.

Second Embodiment

Figure 12:
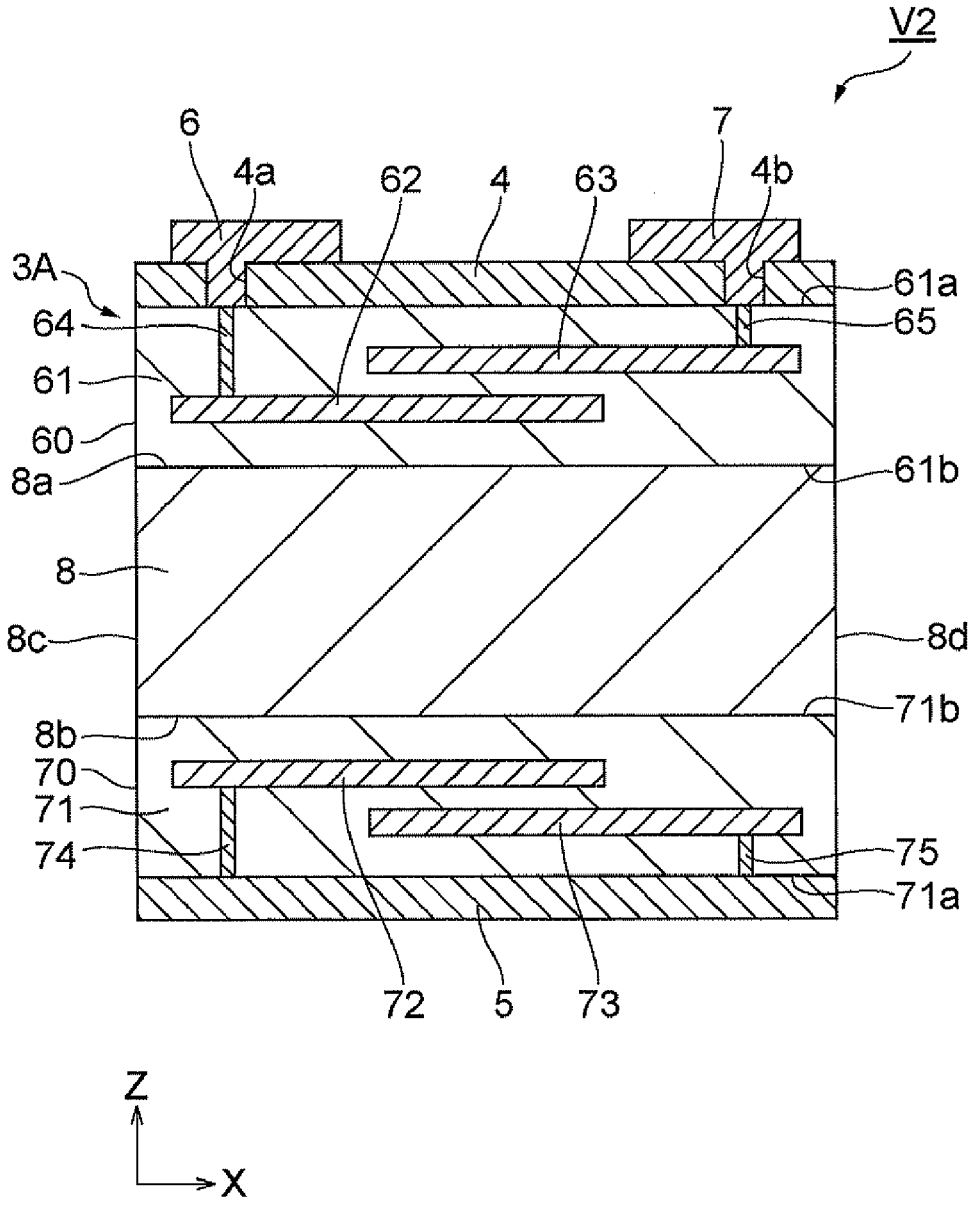
FIG. 12 is a schematic sectional view of a varistor according to the second embodiment.

The varistor according to the second embodiment of the present invention will be described. FIG. 12 is a schematic sectional view showing the varistor according to the second embodiment of the present invention. The varistor V2 shown in FIG. 12 has no surface electrode and is different in a configuration of internal electrodes from the varistor V1 of the first embodiment. The varistor V2 has an element body 3A instead of the element body 3 and this element body 3A has first and second varistor parts 60, 70 instead of the first and second varistor parts 10, 20.

The first varistor part 60 includes a varistor element body 61 of a nearly rectangular parallelepiped shape, a pair of internal electrodes 62, 63 facing each other in the varistor element body 61, and penetrating conductors 64, 65. The varistor element body 61 has a face 61*a* and a face 61*b* facing each other in the Z-direction. An insulating layer 4 is arranged on the face 61*a* and the face 61*b* is in contact with the face 8*a* of the heat dissipation part 8. The internal electrodes 62, 63 are opposed in part to each other in the Z-direction as shifted relative to each other in the X-direction.

The penetrating conductor 64 extends in the Z-direction, one end of which is physically and electrically connected to the internal electrode 62 and the other end of which is exposed from the face 61*a*. The other end of the penetrating conductor 64 is located in the aperture 4*a* of the insulating layer 4 and is physically and electrically connected to the external electrode 6. The penetrating conductor 65 extends in the Z-direction, one end of which is physically and electrically connected to the internal electrode 63 and the other end of which is exposed from the face 61*a*. The other end of the penetrating conductor 65 is located in the aperture 4*b* of the insulating layer 4 and is physically and electrically connected to the external electrode 7. Namely, the internal electrode 62 is electrically connected through the penetrating conductor 64 to the external electrode 6 and the internal electrode 63 is electrically connected through the penetrating conductor 65 to the external electrode 7.

The second varistor part 70 includes a varistor element body 71 of a nearly rectangular parallelepiped shape, a pair of internal electrodes 72, 73 facing each other in the varistor element body 71, and penetrating conductors 74, 75. The varistor element body 71 has a face 71*a* and a face 71*b* facing each other in the Z-direction. An insulating layer 5 is arranged on the face 71*a* and the face 71*b* is in contact with the face 8*b* of the heat dissipation part 8. The internal electrodes 72, 73 are opposed in part to each other in the Z-direction as shifted relative to each other in the X-direction.

The penetrating conductor 74 extends in the Z-direction, one end of which is physically and electrically connected to the internal electrode 72 and the other end of which is exposed from the face 71*a*. The other end of the penetrating conductor 74 is covered by the insulating layer 5. The penetrating conductor 75 extends in the Z-direction, one end of which is physically and electrically connected to the internal electrode 73 and the other end of which is exposed from the face 71*a*. The other end of the penetrating conductor 75 is covered by the insulating layer 5. The first varistor part 60 and the second varistor part 70 are arranged in symmetry with respect to the heat dissipation part 8.

A production method of this varistor V2 will be described. The varistor V2 is produced by a production method similar to that of the varistor V1 in the first embodiment, but, because of the difference in the configuration of the internal electrodes 62, 63, 72, 73 in the first and second varistor parts 60, 70, the process is partly different in the green laminated body formed in the laminating step S5 and in the configuration of the aggregate substrate formed in the firing step S6. The difference will be explained with reference to FIGS. 13 and 14.

Figure 13:
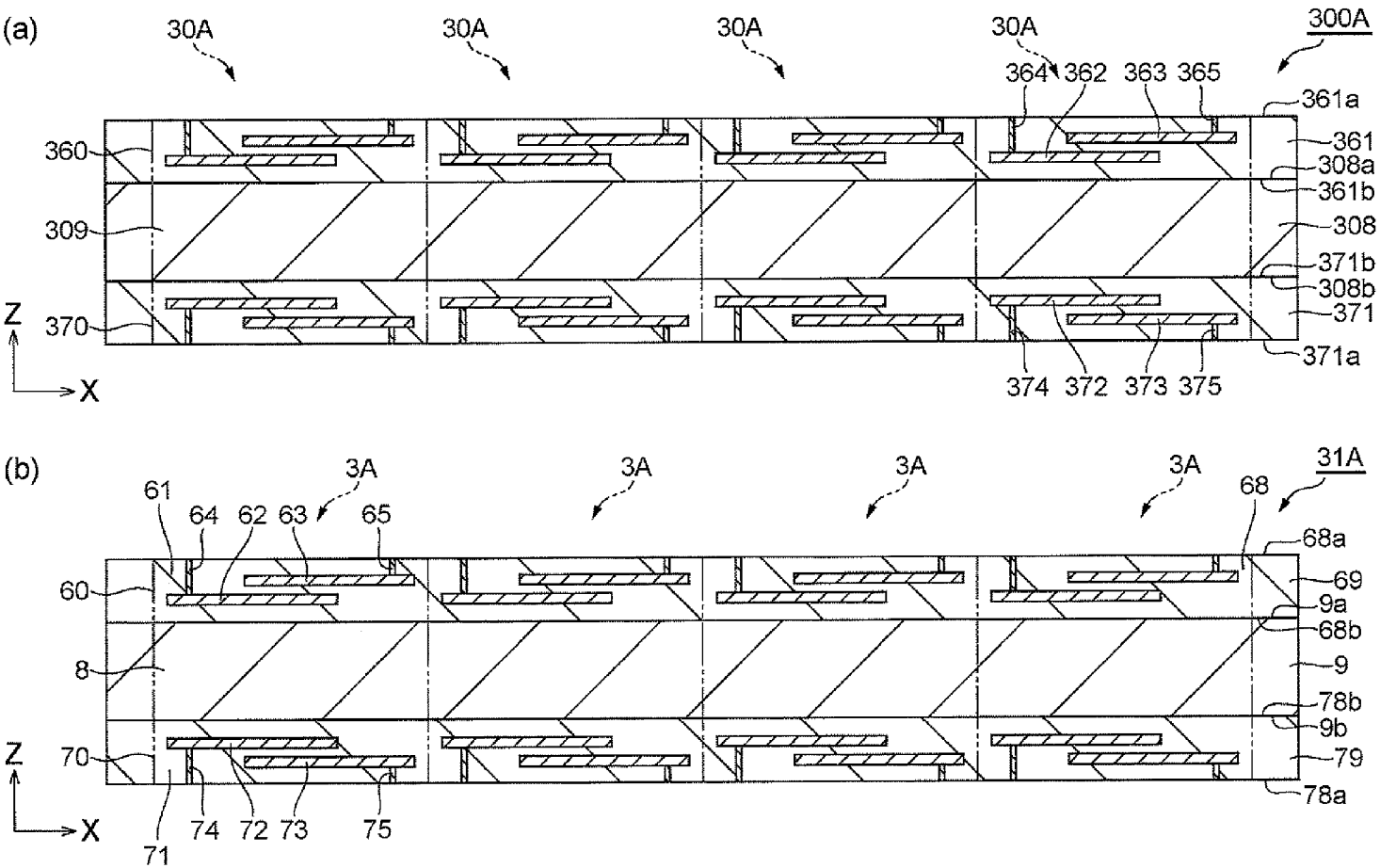
FIG. 13 is schematic sectional views of a green laminated body and an aggregate substrate according to the second embodiment.

FIG. 13(*a*) is a schematic sectional view of the green laminated body. The green laminated body 300A of the second embodiment includes a plurality of green element assemblies 30A. This green laminated body 300A includes a heat dissipation green part 308 to become the heat dissipation part 8, a first varistor green part 360 to become the first varistor part 60, and a second varistor green part 370 to become the second varistor part 70.

The first varistor green part 360 is formed by laminating a varistor green sheet with internal electrode patterns 362 thereon, a varistor green sheet with internal electrode patterns 363 thereon, and varistor green sheets without any electrode pattern in a predetermined order in the Z-direction.

In the varistor green sheets, through holes are preliminarily formed at positions corresponding to the penetrating conductors and these through holes are filled with a conductor paste. Penetrating conductor patterns 364, 365 are formed by laminating the varistor green sheets with the conductor paste in the through holes, as well as the internal electrode patterns 362, 363 thereon.

This leads the first varistor green part 360 to have a varistor green layer 361, a plurality of internal electrode patterns 362, a plurality of internal electrode patterns 363, a plurality of penetrating conductor patterns 364, and a plurality of penetrating conductor patterns 365.

The varistor green layer 361 is composed of a lamination of varistor green sheets and has a principal face 361*a* and a principal face 361*b* facing each other in the Z-direction. The plurality of internal electrode patterns 362 are arranged in the varistor green layer 361 and juxtaposed in the extending directions of the varistor green sheets (the X-direction and Y-direction). The plurality of internal electrode patterns 363 are arranged as opposed in the Z-direction to the respective internal electrode patterns 362.

The plurality of penetrating conductor patterns 364 extend in the Z-direction, one end of each of which is in physical contact with the corresponding one of the plurality of internal electrode patterns 362 and the other end of each of which is exposed from the principal face 361*a*. The plurality of penetrating conductor patterns 365 extend in the Z-direction, one end of each of which is in physical contact with the corresponding one of the plurality of internal electrode patterns 363 and the other end of each of which is exposed from the principal face 361*a*.

The second varistor green part 370 has a varistor green layer 371, a plurality of internal electrode patterns 372, a plurality of internal electrode patterns 373, a plurality of penetrating conductor patterns 374, and a plurality of penetrating conductor patterns 375. The varistor green layer 371 has a principal face 371*a* and a principal face 371*b* facing each other in the Z-direction. The plurality of internal electrode patterns 372 are arranged in the varistor green layer 371 and juxtaposed in the extending directions of the varistor green sheets (the X-direction and Y-direction). The plurality of internal electrode patterns 373 are arranged as opposed in the Z-direction to the respective internal electrode patterns 372.

The plurality of penetrating conductor patterns 374 extend in the Z-direction, one end of each of which is in physical contact with the corresponding one of the plurality of internal electrode patterns 372 and the other end of each of which is exposed from the principal face 371*a*. The plurality of penetrating conductor patterns 375 extend in the Z-direction, one end of each of which is in physical contact with the corresponding one of the plurality of internal electrode patterns 373 and the other end of each of which is exposed from the principal face 371*a*.

The principal face 308*a* of the heat dissipation green part 308 is in contact with the principal face 361*b* of the first varistor green part 360. The principal face 308*b* of the heat dissipation green part 308 is in contact with the principal face 371*b* of the second varistor green part 370. The first varistor green part 360 and the second varistor green part 370 are arranged in symmetry with respect to the heat dissipation green part 308.

An aggregate substrate 31A according to the second embodiment will be explained below with reference to FIG. 13(*b*). The aggregate substrate 31A includes a plurality of element assemblies 3A. This aggregate substrate 31A has a heat dissipation layer 9 made by firing of the heat dissipation green part 308, a first varistor part 69 made by firing of the first varistor green part 360, and a second varistor part 79 made by firing of the second varistor green part 370.

The first varistor part 69 includes a varistor element layer 68 made by firing of the varistor green layer 361, a plurality of internal electrodes 62 made by firing of the plurality of internal electrode patterns 362, a plurality of internal electrodes 63 made by firing of the plurality of internal electrode patterns 363, a plurality of penetrating conductors 64 made by firing of the plurality of penetrating conductor patterns 364, and a plurality of penetrating conductors 65 made by firing of the plurality of penetrating conductor patterns 365. The varistor element layer 68 has a principal face 68*a* made by firing of the varistor green layer 361, and a face 68*b* made by firing of the varistor green layer 361.

The second varistor part 79 includes a varistor element layer 78 made by firing of the varistor green layer 371, a plurality of internal electrodes 72 made by firing of the plurality of internal electrode patterns 372, a plurality of internal electrodes 73 made by firing of the plurality of internal electrode patterns 373, a plurality of penetrating conductors 74 made by firing of the plurality of penetrating conductor patterns 374, and a plurality of penetrating conductors 75 made by firing of the plurality of penetrating conductor patterns 375. The varistor element layer 78 has a principal face 78*a* made by firing of the varistor green layer 371, and a principal face 78*b* made by firing of the varistor green layer 371.

Figure 14:
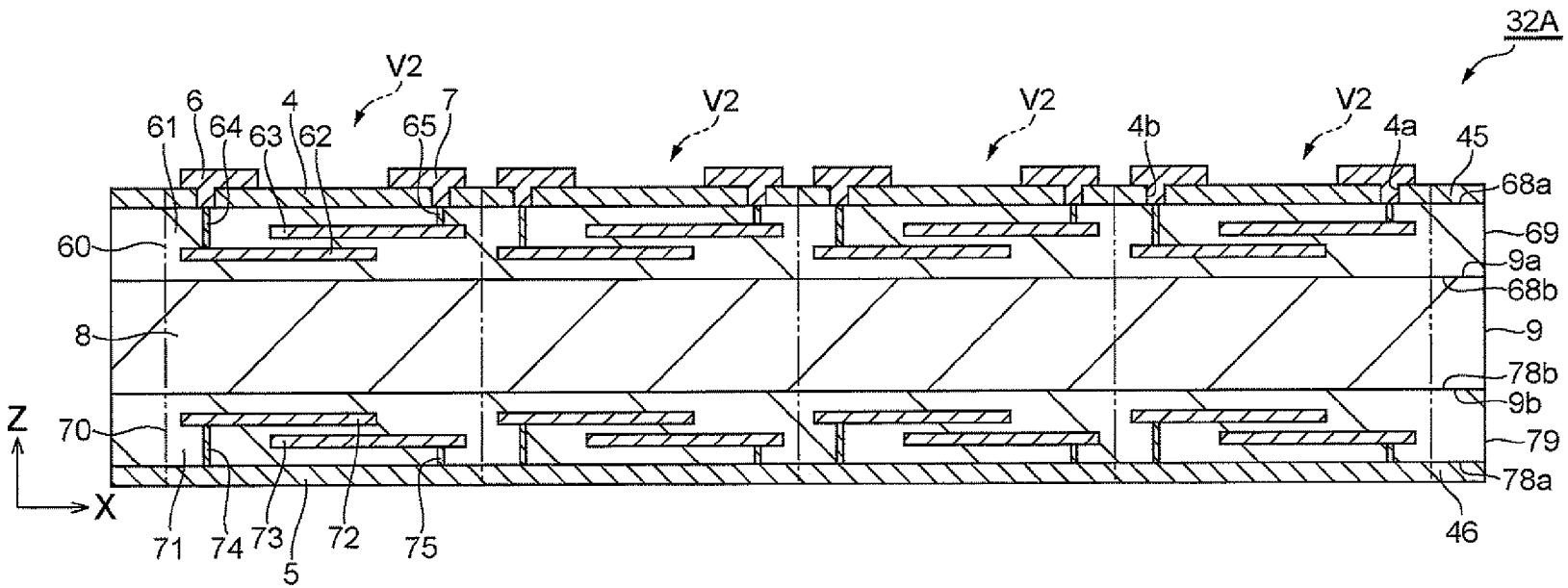
FIG. 14 is a schematic sectional view of an aggregate substrate with external electrodes according to the second embodiment.

An aggregate substrate 32A with external electrodes shown in FIG. 14 is obtained by forming insulating layers 45, 46 on the aggregate substrate 31A and forming plural pairs of external electrodes 6, 7. Each of the plural pairs of external electrodes 6, 7 are physically and electrically connected to the corresponding penetrating conductors 64, 65, respectively. A plurality of varistors V2 are obtained by cutting the aggregate substrate 32A with external electrodes.

In the varistors V2, the varistor element bodies 61, 71 contain ZnO as a main component and the heat dissipation part 8 is made of a composite material of metal Ag and metal oxide including ZnO as the main component of the varistor element bodies 61, 71. Therefore, as in the first embodiment, sufficient joint strength is ensured between the first varistor part 60 and the heat dissipation part 8 and heat transferred from an electronic device through the external electrodes 6, 7 to the varistor part 60 is efficiently dissipated through conduction paths formed from the face 8*a* to the side faces 8*c*-8*f* in the heat dissipation part 8. Sufficient joint strength is also ensured between the second varistor part 70 and the heat dissipation part 8.

There is difference between contraction caused by firing of the heat dissipation green part 308 (heat dissipation part 8) and contraction caused by firing of the first and second varistor green parts 360, 370 (first and second varistor parts 60, 70). However, since the heat dissipation green part 308 is sandwiched between the first varistor green part 360 and the second varistor green part 370 with the first varistor green part 360 being in contact with the principal face 308*a* of the heat dissipation green part 308 and with the second varistor green part 370 being in contact with the principal face 308*b* of the heat dissipation green part 308, the aggregate substrate 31A of planar shape can be formed while suppressing occurrence of warpage during the firing. Since the individual varistors V2 are obtained by forming the external electrodes 6, 7 on the planar aggregate substrate 31A and cutting it, the plurality of varistors V2 with good heat dissipation efficiency can be readily produced.

Third Embodiment

Figure 15:
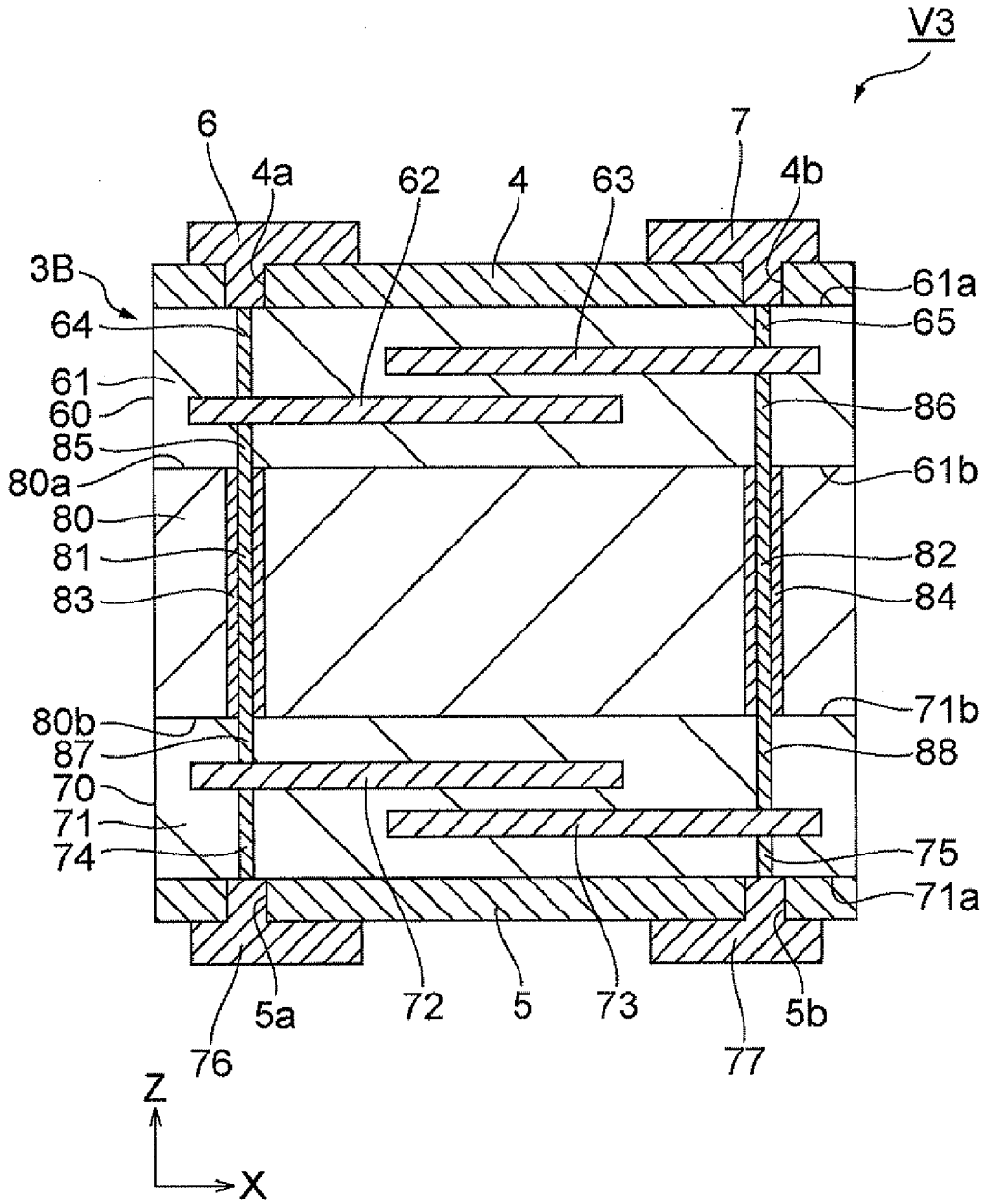
FIG. 15 is a schematic sectional view of a varistor according to the third embodiment.

The varistor according to the third embodiment of the present invention will be described below. FIG. 15 is a schematic sectional view showing the varistor according to the third embodiment of the present invention. The varistor V3 shown in FIG. 15 has an element body 3B, insulating layers 4, 5, a 300 pair of external electrodes 6, 7, and a pair of external electrodes 76, 77. The element body 3B has a first varistor part 60, a second varistor part 70, and a heat dissipation part 80.

The first varistor part 60 includes penetrating conductors 85, 86, in addition to the aforementioned internal electrodes 62, 63 and penetrating conductors 64, 65. The penetrating conductor 85 extends in the Z-direction, one end of which is physically and electrically connected to the internal electrode 62 and the other end of which is exposed from the face 61*b*. The penetrating conductor 86 extends in the Z-direction, one end of which is physically and electrically connected to the internal electrode 63 and the other end of which is exposed from the face 61*b*.

The second varistor part 70 includes penetrating conductors 87, 88, in addition to the aforementioned internal electrodes 72, 73 and penetrating conductors 74, 75. The penetrating conductor 87 extends in the Z-direction, one end of which is physically and electrically connected to the internal electrode 72 and the other end of which is exposed from the face 71*b*. The penetrating conductor 88 extends in the Z-direction, one end of which is physically and electrically connected to the internal electrode 73 and the other end of which is exposed from the face 71*b*.

Apertures 5*a*, 5*b* are formed at positions corresponding to the penetrating conductors 74, 75 in the insulating layer 5. The external electrode 76 is formed so as to cover the aperture 5*a* and is physically and electrically connected to the penetrating conductor 74. The external electrode 77 is formed so as to cover the aperture 5*b* and is physically and electrically connected to the penetrating conductor 75.

The heat dissipation part 80 has a face 80*a* and a face 80*b* facing each other in the Z-direction. The heat dissipation part 80 is made of a material similar to that of the heat dissipation part 8. The heat dissipation part 80 includes two penetrating conductors 81, 82 penetrating the face 80*a* and the face 80*b*, and electrically insulating layers 83, 84 formed around the penetrating conductors 81, 82, respectively.

The penetrating conductor 81 extends in the Z-direction, one end of which is physically and electrically connected to the penetrating conductor 85 and the other end of which is physically and electrically connected to the penetrating conductor 87. This causes the external electrode 6 and external electrode 76 to be electrically connected through the penetrating conductors 64, 85, 81, 87, 74. The penetrating conductor 82 extends in the Z-direction, one end of which is physically and electrically connected to the penetrating conductor 86 and the other end of which is physically and electrically connected to the penetrating conductor 88. This causes the external electrode 7 and external electrode 77 to be electrically connected through the penetrating conductors 65, 86, 82, 88, 75. The first varistor part 60 and the second varistor part 70 are arranged in symmetry with respect to the heat dissipation part 8.

The varistor V3 operates as follows: when the external electrodes 6, 7 are connected to an electronic device, the second varistor part 70, as well as the first varistor part 60, is also connected in parallel to the electronic device and the second varistor part 70 also exercises the function to protect the electronic device from the ESD surge. In the varistor V3, the external electrodes 6, 7 may be used as connecting terminals to the electronic device, or the external electrodes 76, 77 may be used as connecting terminals to the electronic device. It is also possible to use the external electrodes 6, 7 as connecting terminals to an electronic device and the external electrodes 76, 77 as connecting terminals to a substrate.

A production method of this varistor V3 will be explained. The varistor V3 is produced by a production method similar to that of the varistor V2 according to the second embodiment, but, because of the presence of the penetrating conductors 81, 82 and layers 83, 84 in the heat dissipation part 80, the process is partly different in the green laminated body formed in the laminating step S5 and the configuration of the aggregate substrate formed in the firing step S6. The difference will be explained below with reference to FIG. 16.

Figure 16:
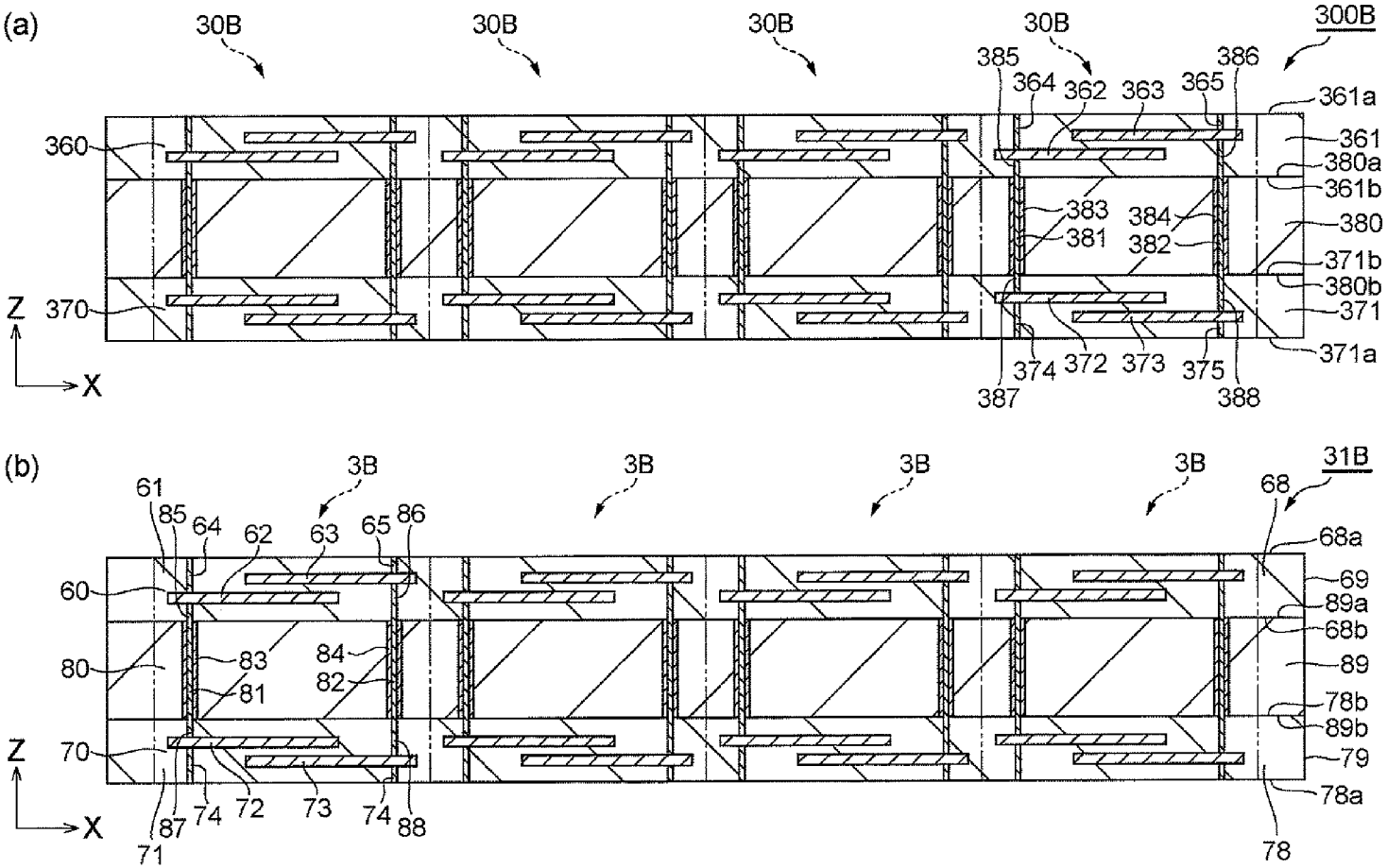
FIG. 16 is schematic sectional views of a green laminated body and an aggregate substrate according to the third embodiment.

FIG. 16(*a*) is a schematic sectional view of the green laminated body. The green laminated body 300B of the third embodiment includes a plurality of green element assemblies 30B. The green laminated body 300B includes a heat dissipation green part 380 to become the heat dissipation part 80, a first varistor green part 360, and a second varistor green part 370.

The heat dissipation green part 380 is formed by laminating heat dissipation green sheets in the Z-direction. Through holes are preliminarily formed in the heat dissipation green sheets and the interior of the through holes is filled with an insulating material to form layers 383, 384. Thereafter, through holes are formed in the central regions of the respective portions filled with the insulating material and a conductor paste is charged into the through holes. The heat dissipation green sheets are laminated to form a plurality of penetrating conductor patterns 381, 382 covered by the respective layers 383, 384.

The heat dissipation green part 380 has a principal face 380*a* and a principal face 380*b* facing each other in the Z-direction. The principal face 380*a* of this heat dissipation green part 380 is in contact with the principal face 361*b* of the first varistor green part 360. The penetrating conductor patterns 381, 382 in the heat dissipation green part 380 are physically connected to the penetrating conductor patterns 385, 386, respectively, in the first varistor green part 360. The principal face 380*b* of the heat dissipation green part 380 is in contact with the principal face 371*b* of the second varistor green part 370. The penetrating conductor patterns 381, 382 in the heat dissipation green part 380 are physically connected to the penetrating conductor patterns 387, 388, respectively, in the second varistor green part 370. The first varistor green part 360 and the second varistor green part 370 are arranged in symmetry with respect to the heat dissipation green part 380.

Subsequently, an aggregate substrate 31B of the third embodiment will be explained with reference to FIG. 16(*b*). The aggregate substrate 31B includes a plurality of element assemblies 3B. The aggregate substrate 31B includes a heat dissipation layer 89 made by firing of the heat dissipation green part 380, a first varistor part 69, and a second varistor part 79. The first varistor part 69 and the second varistor part 79 are arranged in symmetry with respect to the heat dissipation layer 89.

An aggregate substrate with external electrodes is obtained by forming insulating layers 45, 46 on the aggregate substrate 31B and forming plural pairs of external electrodes 6, 7 and plural pairs of external electrodes 76, 77. A plurality of varistors V3 are obtained by cutting the aggregate substrate with external electrodes thus obtained.

In the varistors V3, the varistor element bodies 61, 71 also contain ZnO as a main component and the heat dissipation part 8 is made of a composite material of metal Ag and metal oxide including ZnO as the main component of the varistor element bodies 61, 71. Therefore, sufficient joint strength is ensured between the first varistor part 60 and the heat dissipation part 80 and heat transferred from an electronic device through the external electrodes 6, 7 to the varistor part 60 is efficiently dissipated through conduction paths formed from the face 80*a* to the exposed side faces in the heat dissipation part 80. Sufficient joint strength is also ensured between the second varistor part 70 and the heat dissipation part 80 and heat transferred from an electronic device through the external electrodes 76, 77 to the varistor part 70 is efficiently dissipated through conduction paths formed from the face 80*b* to the exposed side faces in the heat dissipation part 80.

There is difference between contraction caused by firing of the heat dissipation green part 380 (heat dissipation part 80) and contraction caused by firing of the first and second varistor green parts 360, 370 (first varistor part 60 and second varistor part 70). However, since the heat dissipation green part 380 is sandwiched between the first varistor green part 360 and the second varistor green part 370 with the first varistor green part 360 being in contact with the principal face 380*a* of the heat dissipation green part 380 and with the second varistor green part 370 being in contact with the principal face 380*b* of the heat dissipation green part 380, the aggregate substrate 31B of planar shape can be formed while suppressing occurrence of warpage during the firing. Since the individual varistors V3 are obtained by forming the external electrodes 6, 7, 76, 77 on the planar aggregate substrate 31B and cutting it, the plurality of varistors V3 with good heat dissipation efficiency can be readily produced.

Fourth Embodiment

Figure 17:
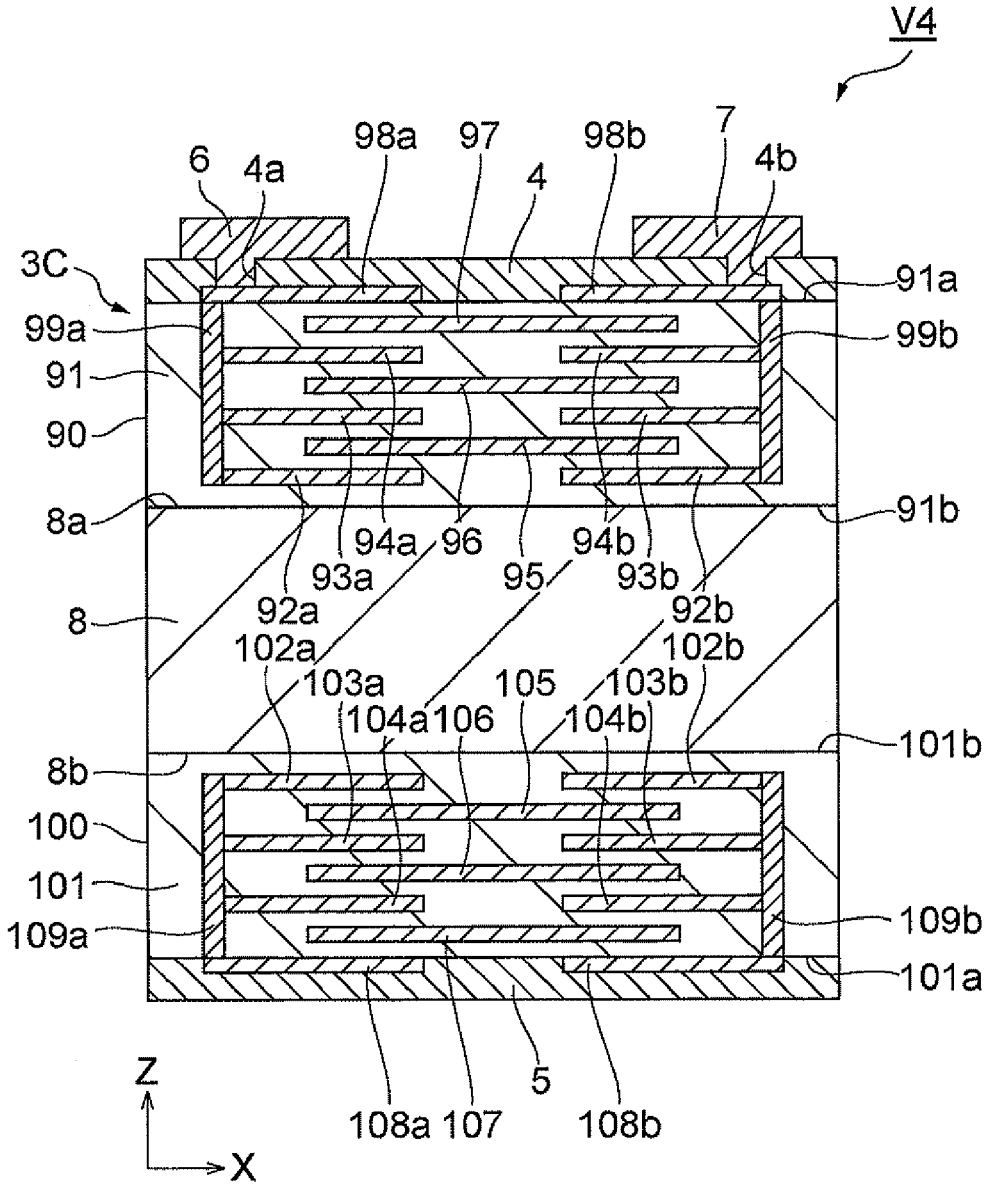
FIG. 17 is a schematic sectional view of a varistor according to the fourth embodiment.

The varistor according to the fourth embodiment of the present invention will be described, FIG. 17 is a schematic sectional view showing the varistor according to the fourth embodiment of the present invention. The varistor V4 shown in FIG. 17 is different in the configuration of internal electrodes in the first and second varistor parts from the varistor V1. The varistor V4 has an element body 3C instead of the element body 3 and the element body 3C has a first varistor part 90, a second varistor part 100, and a heat dissipation part 8.

The first varistor part 90 includes a varistor element body 91, internal electrodes 92*a*-94*a*, 92*b*-94*b*, 95-97, a pair of surface electrodes 98*a*, 98*b*, and penetrating conductors 99*a*, 99*b*. The varistor element body 91 has a face 91*a* and a face 91*b* facing each other in the Z-direction.

The internal electrodes 92*a*-94*a*, 92*b*-94*b*, 95-97 are arranged in the varistor element body 91. The internal electrodes 92*a*, 92*b* are arranged in juxtaposition in the X-direction. The internal electrode 95 is arranged above the internal electrodes 92*a*, 92*b* so that the internal electrode 95 is opposed in the Z-direction through a varistor layer to center-side portions of the internal electrodes 92*a*, 92*b*. Similarly, each pair of the internal electrodes 93*a*, 93*b* and the internal electrodes 94*a*, 94*b* are also arranged in juxtaposition in the X-direction, the internal electrodes 93*a*, 93*b* are arranged through a varistor layer above the internal electrode 95, the internal electrode 96 is arranged through a varistor layer above them, the internal electrodes 94*a*, 94*b* are arranged through a varistor layer above it, and the internal electrode 97 is arranged above them.

The surface electrodes 98*a*, 98*b* are arranged on the face 91*a* of the varistor element body 91 and the center-side portions of the respective surface electrodes 98*a*, 98*b* are opposed to the internal electrode 97. When viewed from the Z-direction, the internal electrodes 92*a*-94*a* and the surface electrode 98*a* overlap with each other, the internal electrodes 92*b*-94*b* and surface electrode 98*b* overlap with each other, and the internal electrodes 95-97 overlap with each other.

Each of the internal electrodes 92*a*-94*a* and the surface electrode 98*a* is physically and electrically connected to the penetrating conductor 99*a* extending in the Z-direction. Each of the internal electrodes 92*b*-94*b* and the surface electrode 98*b* is physically and electrically connected to the penetrating conductor 99*b* extending in the Z-direction. Since the surface electrodes 98*a*, 98*b* are electrically connected to the external electrodes 6, 7, respectively, the internal electrodes 92*a*-94*a* and the internal electrodes 92*b*-94*b* are electrically connected to the external electrodes 6, 7, respectively.

The second varistor part 100 includes a varistor element body 101, internal electrodes 102*a*-104*a*, 102*b*-104*b*, 105-107, a pair of surface electrodes 108*a*, 108*b*, and penetrating conductors 109*a*, 109*b*. The varistor element body 101 has a face 101*a* and a face 101*b* facing each other in the Z-direction.

The internal electrodes 102*a*-104*a*, 102*b*-104*b*, 105-107 are arranged in the varistor element body 101. The internal electrodes 102*a*, 102*b* are arranged in juxtaposition in the X-direction. The internal electrode 105 is arranged below the internal electrodes 92*a*, 92*b* so that the internal electrode 105 is opposed in the Z-direction through a varistor layer to center-side portions of the internal electrodes 102*a*, 102*b*. Similarly, each pair of the internal electrodes 103*a*, 103*b* and the internal electrodes 104*a*, 104*b* are arranged in juxtaposition in the X-direction, the internal electrodes 103*a*, 103*b* are arranged through a varistor layer below the internal electrode 105, the internal electrode 106 is arranged through a varistor layer below them, the internal electrodes 104*a*, 104*b* are arranged through a varistor layer below it, and the internal electrode 107 is arranged below them.

The surface electrodes 108*a*, 108*b* are arranged on the face 101*a* of the varistor element body 101 and the center-side portions of the respective surface electrodes 108*a*, 108*b* are opposed to the internal electrode 107. When viewed from the Z-direction, the internal electrodes 102*a*-104*a* and the surface electrode 108*a* overlap with each other, the internal electrodes 102*b*-104*b* and the surface electrode 108*b* overlap with each other, and the internal electrodes 105-107 overlap with each other.

Each of the internal electrodes 102*a*-104*a* and the surface electrode 108*a* is physically and electrically connected to the penetrating conductor 109*a* extending in the Z-direction. Each of the internal electrodes 102*b*-104*b* and the surface electrode 108*b* is physically and electrically connected to the penetrating conductor 109*b* extending in the Z-direction.

The face 91*b* of the first varistor part 90 is in contact with the face 8*a* of the heat dissipation part 8 and the face 101*b* of the second varistor part 100 is in contact with the face 8*b* of the heat dissipation part 8. The first varistor part 90 and the second varistor part 100 are arranged in symmetry with respect to the heat dissipation part 8.

A production method of this varistor V4 will be explained. The varistor V4 is produced by a production method similar to that of the varistor V1 according to the first embodiment, but, because of the difference in the configuration of the internal electrodes in the first and second varistor parts, the process is partly different in the green laminated body formed in the laminating step S5 and the configuration of the aggregate substrate formed in the firing step S6. The difference will be explained below with reference to FIG. 18.

Figure 18:
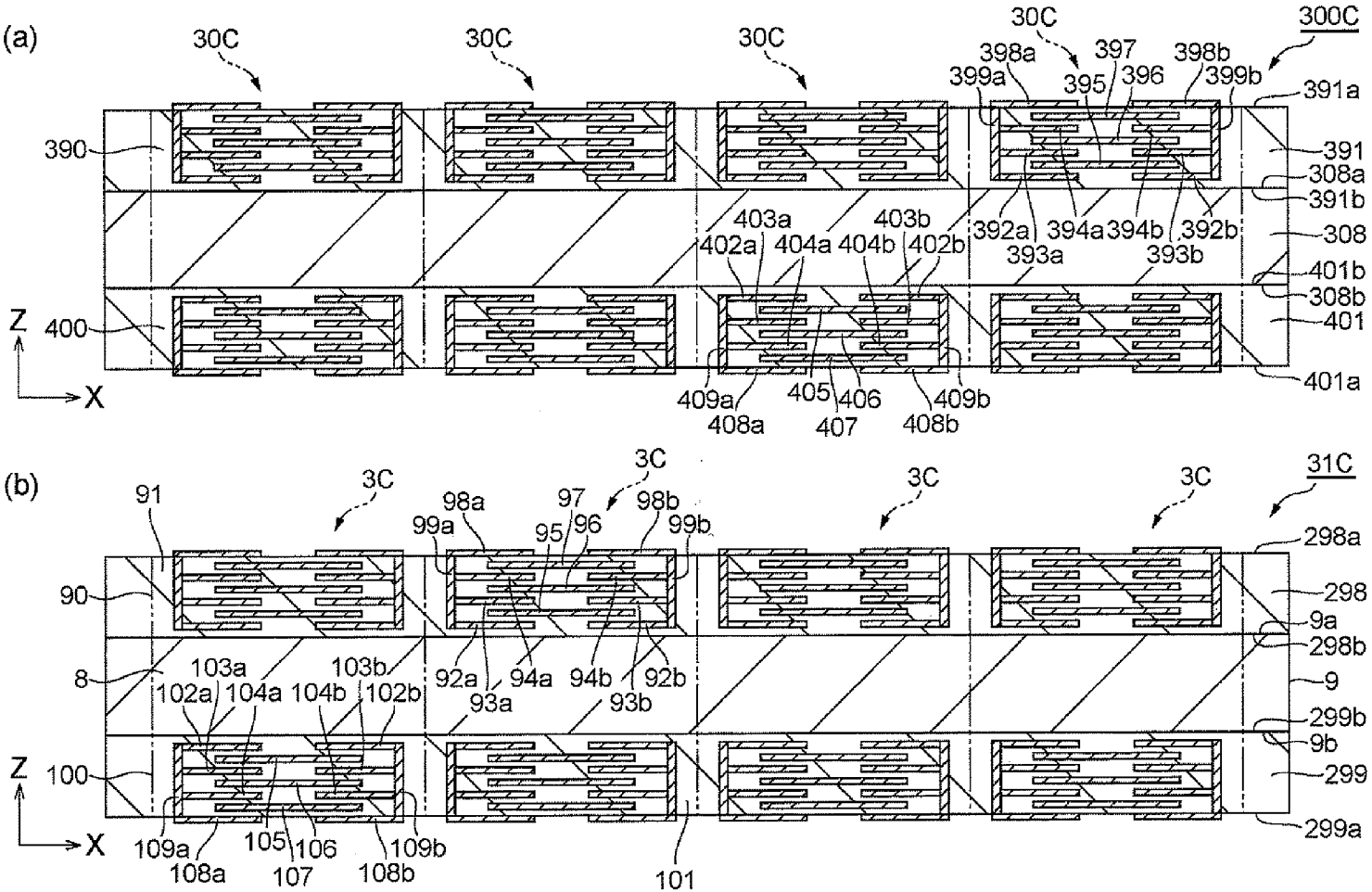
FIG. 18 is schematic sectional views of a green laminated body and an aggregate substrate according to the fourth embodiment.

FIG. 18(*a*) is a schematic sectional view of the green laminated body. The green laminated body 300C of the fourth embodiment includes a plurality of green element assemblies 30C. This green laminated body 300C includes a heat dissipation green part 308, a first varistor green part 390, and a second varistor green part 400.

The first varistor green part 390 includes a varistor green layer 391, a plurality of internal electrode patterns 392*a*-394*a*, 392*b*-394*b*, 395-397, plural pairs of surface electrode patterns 398*a*, 398*b*, and a plurality of penetrating conductor patterns 399*a*, 399*b*. The plurality of internal electrode patterns 392*a*-394*a*, 392*b*-394*b*, 395-397 correspond to the internal electrodes 92*a*-94*a*, 92*b*-94*b*, 95-97, respectively. The plural pairs of surface electrode patterns 398*a*, 398*b* correspond to the pair of surface electrodes 98*a*, 98*b*, respectively. The plurality of penetrating conductor patterns 399*a*, 399*b* correspond to the penetrating conductors 99*a*, 99*b*, respectively.

The first varistor green part 390 is formed by laminating the varistor green sheets with the aforementioned electrode patterns and others in a predetermined order. The varistor green layer 391 has a principal face 391*a* and a principal face 391*b* facing each other in the Z-direction. The principal face 391*b* is in contact with the principal face 308*a* of the heat dissipation green part 308.

The second varistor green part 400 includes a varistor green layer 401, a plurality of internal electrode patterns 402*a*-404*a*, 402*b*-404*b*, 405-407, plural pairs of surface electrode patterns 408*a*, 408*b*, and a plurality of penetrating conductor patterns 409*a*, 409*b*. The plurality of internal electrode patterns 402*a*-404*a*, 402*b*-404*b*, 405-407 correspond to the internal electrodes 102*a*-104*a*, 102*b*-104*b*, 105-107, respectively. The plural pairs of surface electrode patterns 408*a*, 408*b* correspond to the pair of surface electrodes 108*a*, 108*b*, respectively. The plurality of penetrating conductor patterns 409*a*, 409*b* correspond to the penetrating conductors 109*a*, 109*b*, respectively.

The second varistor green part 400 is formed by laminating the varistor green sheets with the aforementioned electrode patterns and others in a predetermined order. The varistor green layer 401 has a principal face 401*a* and a principal face 401*b* facing each other in the Z-direction. The principal face 401*b* is in contact with the principal face 308*a* of the heat dissipation green part 308. The first varistor green part 390 and the second varistor green part 400 are arranged in symmetry with respect to the heat dissipation green part 308.

Subsequently, an aggregate substrate 31C of the fourth embodiment will be described with reference to FIG. 18(*b*). The aggregate substrate 31C includes a plurality of element assemblies 3C. This aggregate substrate 31C includes a heat dissipation layer 9, a first varistor part 298 made by firing of the first varistor green part 390, and a second varistor part 299 made by firing of the second varistor green part 400. The first varistor green part 390 and the second varistor green part 400 are arranged in symmetry with respect to the heat dissipation layer 9.

An aggregate substrate with external electrodes is obtained by forming insulating layers 45, 46 on the aggregate substrate 31C and forming plural pairs of external electrodes 6, 7. A plurality of varistors V4 are obtained by cutting the aggregate substrate with external electrodes thus obtained.

In the varistors V4, the varistor element bodies 91, 101 also contain ZnO as a main component and the heat dissipation part 8 is made of a composite material of metal Ag and metal oxide including ZnO as the main component of the varistor element bodies 91, 101. Therefore, as in the first embodiment, sufficient joint strength is ensured between the first varistor part 90 and the heat dissipation part 8 and heat transferred from an electronic device through the external electrodes 6, 7 to the first varistor part 90 is efficiently dissipated through conduction paths formed from the face 80*a* to the exposed side faces in the heat dissipation part 8. Sufficient joint strength is also ensured between the second varistor part 100 and the heat dissipation part 8.

There is difference between contraction caused by firing of the heat dissipation green part 308 (heat dissipation part 8) and contraction caused by firing of the first and second varistor green parts 390, 400 (first varistor part 90 and second varistor part 100). However, since the heat dissipation green part 308 is sandwiched between the first varistor green part 390 and the second varistor green part 400 with the first varistor green part 390 being in contact with the principal face 308*a* of the heat dissipation green part 308 and with the second varistor green part 400 being in contact with the principal face 308*b* of the heat dissipation green part 308, the aggregate substrate 31C of planar shape can be formed while suppressing occurrence of warpage during the firing. Since the individual varistors V4 are obtained by forming the external electrodes 6, 7 on the planar aggregate substrate 31C and cutting it, the plurality of varistors V4 with good heat dissipation efficiency can be readily produced.

Fifth Embodiment

Figure 19:
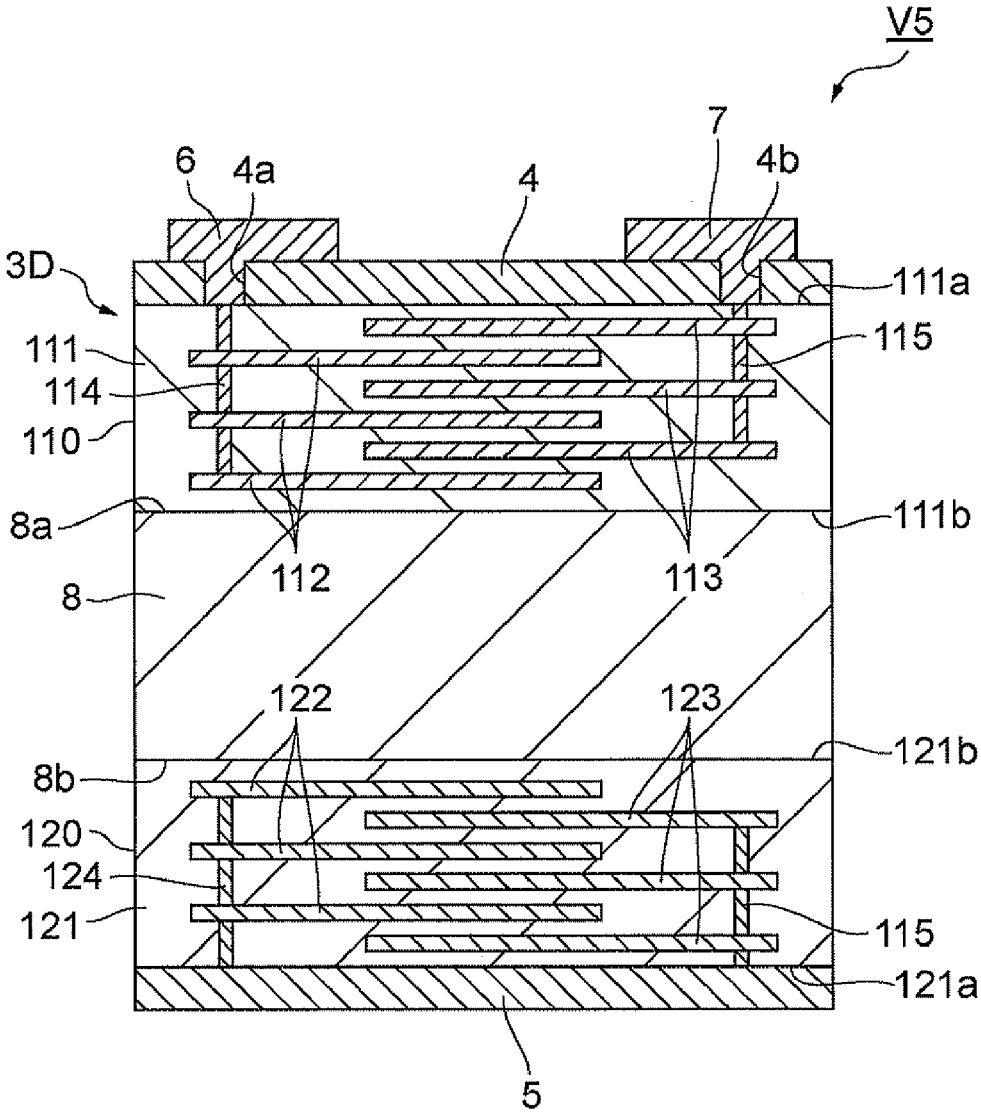
FIG. 19 is a schematic sectional view of a varistor according to the fifth embodiment.

The varistor according to the fifth embodiment of the present invention will be explained. FIG. 19 is a schematic sectional view showing the varistor according to the fifth embodiment of the present invention. The varistor V5 shown in FIG. 19 is different from the varistor V2 of the second embodiment in that paired internal electrodes are formed in plural pairs (three pairs in the present embodiment). The varistor V5 has an element body 3D instead of the element body 3, and the element body 3D has first and second varistor parts 110, 120 instead of the first and second varistor parts 10, 20.

The first varistor part 110 includes a varistor element body 111 of a nearly rectangular parallelepiped shape, three pairs of internal electrodes 112, 113 facing each other in the varistor element body 111, and penetrating conductors 114, 115. The varistor element body 111 has a face 111*a* and a face 111*b* facing each other in the Z-direction. The face 111*b* is in contact with the face 8*a* of the heat dissipation part 8. The internal electrodes 112, 113 are opposed in part in the Z-direction to each other as shifted relative to each other in the X-direction. The internal electrodes 112 and the internal electrodes 113 are alternately laminated with a varistor layer in between.

The penetrating conductor 114 extends in the Z-direction and is physically and electrically connected to the three internal electrodes 112, and the tip thereof is exposed from the face 111*a*. The tip of the penetrating conductor 114 is located in the aperture 4*a* of the insulating layer 4 and physically and electrically connected to the external electrode 6. The penetrating conductor 115 extends in the Z-direction and is physically and electrically connected to the three internal electrodes 113, and the other end thereof is exposed from the face 111*a*. The tip of the penetrating conductor 115 is located in the aperture 4*b* of the insulating layer 4 and physically and electrically connected to the external electrode 7. Namely, the internal electrodes 112 are electrically connected to the external electrode 6 through the penetrating conductor 114 and the internal electrodes 113 are electrically connected to the external electrode 7 through the penetrating conductor 115.

The second varistor part 120 includes a varistor element body 121 of a nearly rectangular parallelepiped shape, three pairs of internal electrodes 122, 123 facing each other in the varistor element body 121, and penetrating conductors 124, 125. The varistor element body 121 has a face 121*a* and a face 121*b* facing each other in the Z-direction. The insulating layer 5 is arranged on the face 121*a* and the face 121*b* is in contact with the face 8*b* of the heat dissipation part 8. The internal electrodes 122, 123 are opposed in part in the Z-direction to each other as shifted relative to each other in the X-direction. The internal electrodes 122 and the internal electrodes 123 are alternately laminated with a varistor layer in between.

The penetrating conductor 124 extends in the Z-direction and is physically and electrically connected to the three internal electrodes 122, and the tip thereof is exposed from the face 121*a* and covered by the insulating layer 5. The penetrating conductor 125 extends in the Z-direction and is physically and electrically connected to the three internal electrodes 123, and the tip thereof is exposed from the face 121*a* and covered by the insulating layer 5. The first varistor part 110 and the second varistor part 120 are arranged in symmetry with respect to the heat dissipation part 8.

A production method of the varistor V5 will be explained. The varistor V5 is produced by a production method similar to that of the varistor V2 of the second embodiment, but, because of the difference in the configuration of the internal electrodes in the first and second varistor parts, the process is partly different in the green laminated body formed in the laminating step S5 and the configuration of the aggregate substrate formed in the firing step S6. The difference will be explained below with reference to FIG. 20.

Figure 20:
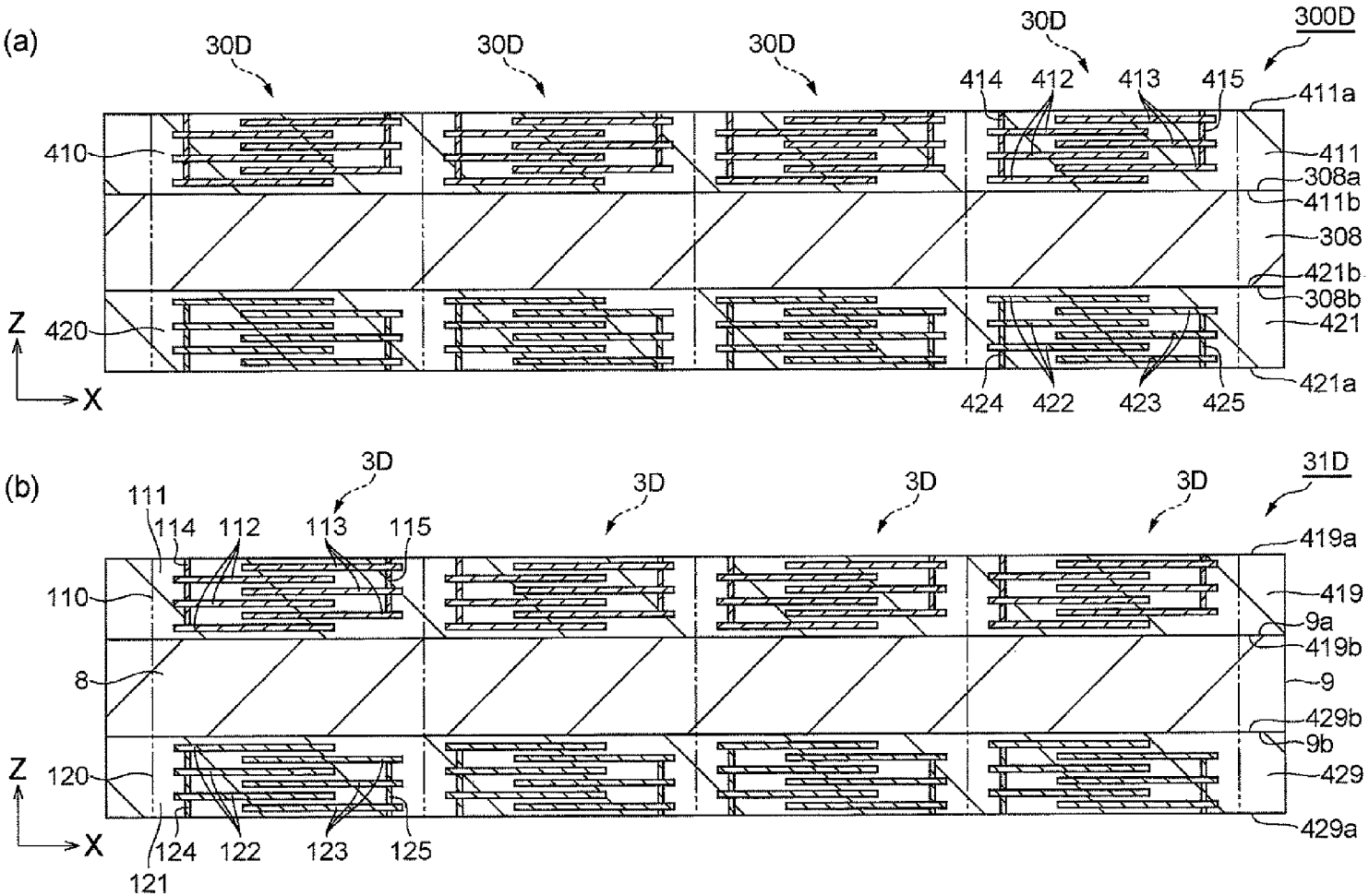
FIG. 20 is schematic sectional views of a green laminated body and an aggregate substrate according to the fifth embodiment.

FIG. 20(*a*) is a schematic sectional view of the green laminated body. The green laminated body 300D of the fifth embodiment includes a plurality of green element assemblies 30D. This green laminated body 300D includes a heat dissipation green part 308, a first varistor green part 410, and a second varistor green part 420.

The first varistor green part 410 includes a varistor green layer 411, a plurality of internal electrode patterns 412, 413, and a plurality of penetrating conductor patterns 414, 415. The plurality of internal electrode patterns 412, 413 correspond to the internal electrodes 112, 113, respectively. The plurality of penetrating conductor patterns 414, 415 correspond to the penetrating conductors 114, 115, respectively.

The first varistor green part 410 is formed by laminating the varistor green sheets with the aforementioned electrode patterns and others in a predetermined order. The varistor green layer 411 has a principal face 411*a* and a principal face 411*b* facing each other in the Z-direction. The principal face 411*b* is in contact with the principal face 308*a* of the heat dissipation green part 308.

The second varistor green part 420 includes a varistor green layer 421, a plurality of internal electrode patterns 422, 423, and a plurality of penetrating conductor patterns 424, 425. The plurality of internal electrode patterns 422, 423 correspond to the internal electrodes 122, 123, respectively. The plurality of penetrating conductor patterns 424, 425 correspond to the penetrating conductors 124, 125, respectively.

The second varistor green part 420 is formed by laminating the varistor green sheets with the electrode patterns and others in a predetermined order. The varistor green layer 421 has a principal face 421*a* and a principal face 421*b* facing each other in the Z-direction. The principal face 421*b* is in contact with the principal face 308*a* of the heat dissipation green part 308. The first varistor green part 410 and the second varistor green part 420 are arranged in symmetry with respect to the heat dissipation green part 308.

The aggregate substrate 31D of the fifth embodiment will be described below with reference to FIG. 20(*b*). The aggregate substrate 31D includes a plurality of element assemblies 3D. This aggregate substrate 31D includes a heat dissipation layer 9, a first varistor part 110 made by firing of the first varistor green part 410, and a second varistor part 120 made by firing of the second varistor green part 420. The first varistor part 110 and the second varistor green part 120 are arranged in symmetry with respect to the heat dissipation layer 9.

An aggregate substrate with external electrodes is obtained by forming the insulating layers 45, 46 on the aggregate substrate 31D and forming plural pairs of external electrodes 6, 7. A plurality of varistors V5 are obtained by cutting the aggregate substrate with external electrodes thus obtained.

In the varistors V5, the varistor element bodies 111, 121 also contain ZnO as a main component and the heat dissipation part 8 is made of a composite material of metal Ag and metal oxide including ZnO as the main component of the varistor element bodies 111, 121. Therefore, as in the first embodiment, sufficient joint strength is ensured between the first varistor part 110 and the heat dissipation part 8 and heat transferred from an electronic device through the external electrodes 6, 7 to the first varistor part 110 is efficiently dissipated through conduction paths formed from the side face 8*a* to the exposed side faces in the heat dissipation part 8. Sufficient joint strength is also ensured between the second varistor part 120 and the heat dissipation part 8.

There is difference between contraction caused by firing of the heat dissipation green part 308 (heat dissipation part 8) and contraction caused by firing of the first and second varistor green parts 410, 420 (first and second varistor parts 110, 120). Since the heat dissipation green part 308 is sandwiched between the first varistor green part 410 and the second varistor green part 420 with the first varistor green part 410 being in contact with the principal face 308*a* of the heat dissipation green part 308 and with the second varistor green part 420 being in contact with the principal face 308*b* of the heat dissipation green part 308, the aggregate substrate 31D of planar shape can be formed while suppressing occurrence of warpage during the firing. Since the individual varistors V5 are obtained by forming the external electrodes 6, 7 on the planar aggregate substrate 31D and cutting it, the plurality of varistors V5 with good heat dissipation efficiency can be readily produced.

The present invention is not limited to the above embodiments, but can be modified in many ways.

In the above first to fifth embodiments, the first varistor green part 310, 360, 390, 410 and the second varistor green part 320, 370, 400, 420 are arranged in symmetry with respect to the heat dissipation green part 308, 380 in the green laminated body 300, 300A-300D, but the present invention is not limited to this configuration. The first varistor green part 310, 360, 390, 410 and the second varistor green part 320, 370, 400, 420 in the green laminated body 300, 300A-300D may be shifted relative to each other in the X-direction, and the thicknesses of the respective constituent elements may be different between them. In connection with the aforementioned configuration, the first varistor part 19, 69, 298, 419 and the second varistor part 29, 79, 299, 429 are arranged in symmetry with respect to the heat dissipation layer 9, 89 in the aggregate substrate 31, 31A-31D, but the present invention is not limited to this configuration. The first varistor part 19, 69, 298, 419 and the second varistor part 29, 79, 299, 429 in the aggregate substrate 31, 31A-31D may be shifted relative to each other in the X-direction, and the thicknesses of the respective constituent elements may be different between them. Furthermore, the first varistor part 10, 60, 90, 110 and the second varistor part 20, 70, 100, 120 are arranged in symmetry with respect to the heat dissipation part 8, 80 in the varistor V1-V5, but the present invention is not limited to this configuration. The first varistor part 10, 60, 90, 110 and the second varistor part 20, 70, 100, 120 in the varistor V1-V5 may be shifted relative to each other in the X-direction, and the thicknesses of the respective constituent elements may be different between them.

In the first and fourth embodiments the surface electrodes 13, 14, 23, 24, 98*a*, 98*b*, 108*a*, 108*b* are formed by firing the electroconductive paste in the firing step S6, but the present invention is not limited to this method. The surface electrodes 13, 14, 23, 24, 98*a*, 98*b*, 108*a*, 108*b* may be formed as follows: after the firing step S6, an electroconductive paste is applied on the resultant aggregate substrate and it is then sintered.

Each of the above embodiments exemplified ZnO as a semiconductor ceramic being the main component of the varistor element body 11, 21, 61, 71, 91, 101, 111, 121, but it is also possible to use any one of semiconductor ceramics other than ZnO, e.g., $SrTiO_3$, $BaTiO_3$, SiC, and so on.

The devices to be connected to the varistor V1-V5 can be nitride-base semiconductor LEDs except for the GaN type, e.g., InGaNAs-base semiconductor LEDs, or semiconductor LEDs and LDs except for the nitride type. Besides the LEDs, the varistor may be connected to a variety of electronic devices that generate heat during operation, e.g., field effect transistors (FETs), bipolar transistors, and so on.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An aggregate substrate comprising:

a first varistor part comprising a first varistor element layer to exhibit nonlinear voltage-current characteristics, and a plurality of first internal electrodes juxtaposed in an extending direction of the first varistor element layer in the first varistor element layer, said first varistor part having a first principal face and a second principal face facing each other;

a second varistor part comprising a second varistor element layer to exhibit nonlinear voltage-current characteristics, and a plurality of second internal electrodes juxtaposed in an extending direction of the second varistor element layer in the second varistor element layer, said second varistor part having a third principal face and a fourth principal face facing each other; and a heat dissipation layer having a fifth principal face and a sixth principal face facing each other, wherein the fifth principal face of the heat dissipation layer is in contact with the second principal face of the first varistor part and wherein the sixth principal face of the heat dissipation layer is in contact with the fourth principal face of the second varistor part, wherein the first varistor part further comprises a plurality of pairs of first surface electrodes formed on the first principal face, wherein the second varistor part further comprises a plurality of pairs of second surface electrodes formed on the third principal face, wherein each of the first surface electrodes in each pair is opposed at least in part to the corresponding first internal electrode, and wherein each of the second surface electrodes in each pair is opposed at least in part to the corresponding second internal electrode.

2. The aggregate substrate according to claim 1, further comprising:

a plurality of first external electrodes each of which is electrically connected to one first surface electrode out of the first surface electrodes in each pair; and a plurality of second external electrodes each of which is electrically connected to the other first surface electrode out of the first surface electrodes in each pair.

3. The aggregate substrate according to claim 1, wherein the first varistor part further comprises a plurality of third internal electrodes, wherein the second varistor part further comprises a plurality of fourth internal electrodes, wherein each of said third internal electrodes is opposed to the corresponding first internal electrode in an opposing direction of the first principal face and the second principal face, and wherein each of said fourth internal electrodes is opposed to the corresponding second internal electrode in the opposing direction of the first principal face and the second principal face.

4. The aggregate substrate according to claim 3, further comprising:

a plurality of first external electrodes electrically connected to the respective first internal electrodes, and a plurality of second external electrodes electrically connected to the respective second internal electrodes.

5. A production method of an aggregate substrate comprising:

a preparation step of preparing a first green sheet containing a varistor material, a second green sheet containing a varistor material and having a plurality of internal electrode patterns formed thereon, and a third green sheet containing a heat dissipation material, the heat dissipation material is a composite material of metal and metal oxide and differs from the varistor material in contraction caused by firing;

a laminating step of laminating the first to third green sheets prepared, to obtain a green laminated body having a first varistor green part, a second varistor green part, and a heat dissipation part; and a firing step of firing the green laminated body to obtain an aggregate substrate, wherein the laminating step comprises laying the third green sheet between a first portion made by at least laying the first green sheet on the second green sheet, and a second portion made by at least laying the first green sheet on the second green sheet, so as to be in contact with the first and second portions, thereby obtaining the green laminated body.

6. The production method of the aggregate substrate according to claim 5, wherein the preparation step comprises further preparing a fourth green sheet containing a varistor material and having a plurality of surface electrode patterns, and wherein the laminating step comprises laying the fourth green sheet so that the plurality of surface electrode patterns are located on a surface of the green laminated body.

7. The production method of the aggregate substrate according to claim 5, wherein the laminating step comprises laying at least two second green sheets so that the plurality of internal electrode patterns are opposed, in each of the first and second portions.

8. A varistor comprising:

a first varistor part having a first face and a second face facing each other;

a second varistor part having a third face and a fourth face facing each other;

a heat dissipation part located between the first and second varistor parts and being in contact with the second and fourth faces; and a pair of external electrodes arranged on the first varistor part, wherein the first varistor part comprises a first varistor element body to exhibit nonlinear voltage-current characteristics, a first internal electrode arranged in the first varistor element body, and a pair of first surface electrodes arranged on the first face and each opposed at least in part to the first internal electrode, wherein the second varistor part comprises a second varistor element body to exhibit nonlinear voltage-current characteristics, a second internal electrode arranged in the second varistor element body, and a pair of second surface electrodes arranged on the third face and each opposed at least in part to the second internal electrode, wherein the heat dissipation part is made of a composite material of metal and metal oxide and differs from the first and second varistor element bodies in contraction caused by firing, and wherein each of said external electrodes is electrically connected to the corresponding first surface electrode.

9. A varistor comprising:

a first varistor part having a first face and a second face facing each other;

a second varistor part having a third face and a fourth face facing each other;

a heat dissipation part located between the first and second varistor parts and being in contact with the second and fourth faces; and a pair of external electrodes arranged on the first varistor part, wherein the first varistor part comprises a first varistor element body to exhibit nonlinear voltage-current characteristics, and first and second internal electrodes arranged in the first varistor element body and opposed to each other in an opposing direction of the first and the second faces, wherein the second varistor part comprises a second varistor element body to exhibit nonlinear voltage-current characteristics, and third and fourth internal electrodes arranged in the second varistor element body and opposed to each other in an opposing direction of the third and the fourth faces, wherein the heat dissipation part is made of a composite material of metal and metal oxide and differs from the first and second varistor element bodies in contraction caused by firing, and wherein said pair of external electrodes are electrically connected to the first and the second internal electrodes, respectively.

10. An aggregate substrate comprising:

a first varistor part comprising a first varistor element layer to exhibit nonlinear voltage-current characteristics, and a plurality of first internal electrodes juxtaposed in the first varistor element layer;

a second varistor part comprising a second varistor element layer to exhibit nonlinear voltage-current characteristics, and a plurality of second internal electrodes juxtaposed in the second varistor layer; and a heat dissipation layer located between the first and second varistor parts and being in contact with the first and second varistor parts, wherein the heat dissipation layer is made of a composite material of metal and metal oxide and differs from the first and second varistor element layers in contraction caused by firing.

* * * * *